US010479560B1

(12) United States Patent
Calo

(10) Patent No.: US 10,479,560 B1
(45) Date of Patent: Nov. 19, 2019

(54) CONVERTIBLE BAG

(71) Applicant: Jeremie Calo, Eatonton, GA (US)

(72) Inventor: Jeremie Calo, Eatonton, GA (US)

( * ) Notice: Subject to any disclaimer, the term of this patent is extended or adjusted under 35 U.S.C. 154(b) by 0 days.

(21) Appl. No.: 16/237,203

(22) Filed: Dec. 31, 2018

(51) Int. Cl.

| | |
|---|---|
| ***B65D 33/16*** | (2006.01) |
| ***B65D 30/00*** | (2006.01) |
| *A45C 9/00* | (2006.01) |
| *A41B 13/10* | (2006.01) |

(52) U.S. Cl.
CPC ..... *B65D 33/16* (2013.01); *B65D 31/005* (2013.01); *A41B 13/10* (2013.01); *A45C 9/00* (2013.01)

(58) Field of Classification Search
CPC ..... B65D 33/16; B65D 31/005; A41B 13/10; A41B 13/103; A45C 9/00
USPC ..... 383/4, 7, 14, 22, 62, 77, 127; 2/49.1, 2/49.2
See application file for complete search history.

(56) References Cited

U.S. PATENT DOCUMENTS 2,949,611 A * 8/1960 Schwable Wilkaitis ..... A41B 13/10 2/49.1
4,618,992 A * 10/1986 La Grotteria ..... B65D 81/36 229/236
5,056,159 A * 10/1991 Zemke, Jr. ..... A41B 13/10 2/46
6,113,266 A * 9/2000 Skidmore ..... B60N 2/286 383/11
7,360,256 B1 * 4/2008 Jiles ..... A41B 13/10 2/48
2007/0258662 A1 * 11/2007 Venditti ..... B65D 5/54 383/4
2008/0060108 A1 * 3/2008 Gors ..... A41B 13/103 2/48
2010/0163610 A1 * 7/2010 Shamsnobari ..... A47G 21/001 229/164
2013/0034314 A1 * 2/2013 Peacock ..... B65D 33/00 383/29
2016/0083143 A1 * 3/2016 Padan ..... B65D 31/06 206/216
2016/0376084 A1 * 12/2016 Wein ..... B65D 81/363 206/541

FOREIGN PATENT DOCUMENTS

DE 3009577 A1 * 9/1981 ..... A41B 13/10
EP 1862086 A1 * 12/2007 ..... A41D 13/12
WO WO-0012398 A1 * 3/2000 ..... B65D 33/00
WO WO-2008113016 A1 * 9/2008 ..... A41B 13/103

* cited by examiner

*Primary Examiner* — Jes F Pascua
(74) *Attorney, Agent, or Firm* — Michael J. Bootcheck, LLC; Michael J. Bootcheck

(57) ABSTRACT

A bag convertible to a bib. The bag is comprised of a primary flexible material (such as paper) and may also incorporate an attachment mechanism and a scored or perforated portion. Score lines enable a user to transform a portion of the bag walls from the open end of the bag into the straps of a bib. With the straps of the bag unfurled, the user can connect the strap ends to each other behind the neck of the user (or, if there is one long strap, around the neck of the user and then re-connected to the bag), such that the remainder of the bag hangs from the user's neck presenting a portion of the bag to collect falling debris, and a bib surface which rests on the chest (or clothing, etc.) of the user to intercept spillage.

2 Claims, 44 Drawing Sheets

CONVERTIBLE BAG

FIELD OF THE INVENTION

The present invention relates to bags, and more particularly, to a bag incorporating perforations which allows a user to convert the bag into a bib having one or more straps extending therefrom.

BACKGROUND OF THE INVENTION

Fast food is enormously popular with consumers. Many consumers purchase this fast food and sauces at the restaurant's drive thru so that they may stay in their vehicle and eat the food on the go in the vehicle. Typically, the food is placed into a paper bag and then provided to the consumer after they pay for the meal. The consumer then withdraws the food from the bag. Though commonly used for hamburgers, sandwiches, french fries, an infinite variety of foodstuffs are available. Many of these foodstuffs include sauces in the food article itself, or dipping sauces for the food article (i.e., mustard, ketchup, etc. for french fries). Unfortunately, many of these consumers and their children will drop food particles as they eat. Sometimes the food and sauces may fall onto the person, or into the vehicle. What is needed is a single-use, ready-made bib available to the consumer so that they won't get food or other debris on their clothing. What would also be convenience is if there would be a ledge or other area for catching and holding these foodstuffs.

SUMMARY OF THE INVENTION

It is to be understood that both the foregoing general description and the following detailed description present embodiments of the invention, and are intended to provide an overview, or framework, for understanding the nature and character of the invention as it is claimed. The accompanying drawings are included to provide a further understanding of the invention, and are incorporated into and constitute part of this specification. The drawings illustrate various embodiments of the invention and, together with the description serve to explain the principles and operations of the invention.

The present is a bag, the bag comprised of: a flexible material including a floor and a plurality of upstanding walls projecting from the floor, wherein each two adjacent walls meet one another at a corner of the bag, and there is at least one perforated section near the opening of the bag such that a user may rip the bag along the perforations to reveal one or more straps.

In another embodiment, the present is a bag, the bag comprised of: a flexible material including a floor and a plurality of upstanding walls projecting from the floor, wherein each two adjacent walls meet one another at a corner of the bag, and a notch in at least one of the walls and wherein a first set of perforations is generally parallel to the top of the bag and a second set of perforations is generally orthogonal to the top of the bag and extends from the notch or extends from any other location located within the collar belt, and such that a user may rip the bag along the perforations to reveal one or more straps.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains. In the figures, like reference numbers represent the same component.

Figure 1:
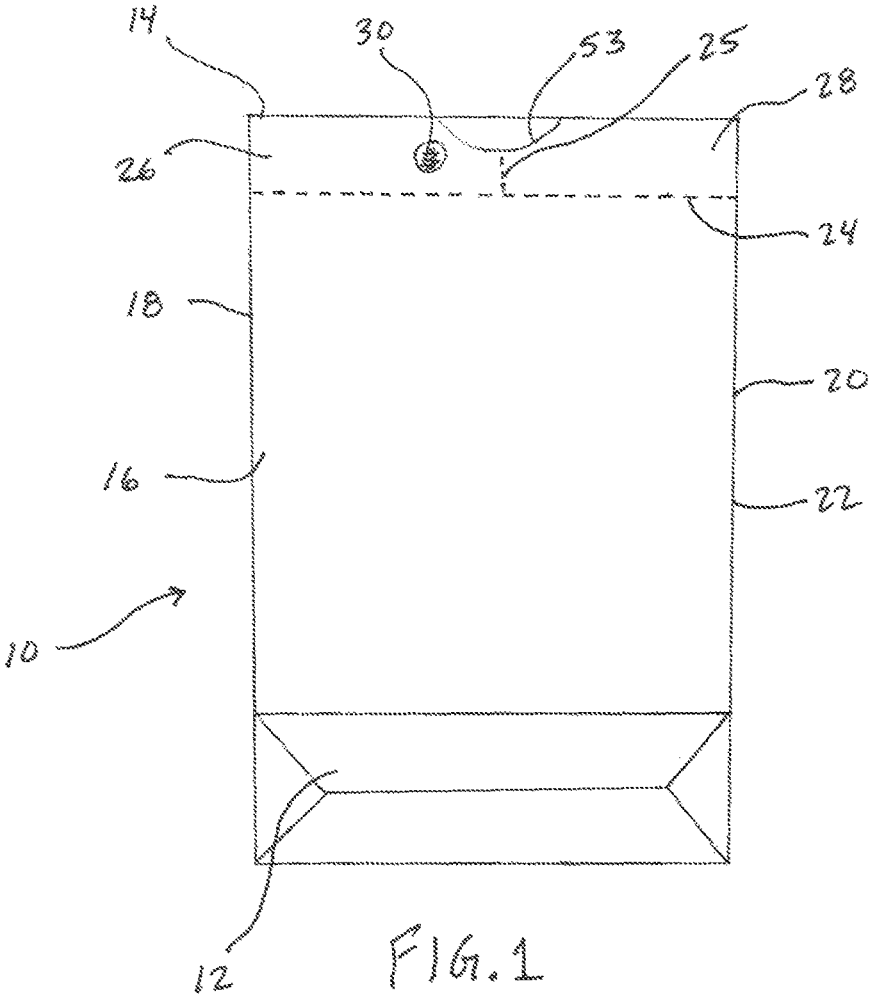
FIG. 1 is a front view of an exemplary embodiment of the present invention having horizontal and vertical perforations where the perforations do not extend the entirety of the back of the bag and having an adhesive for connecting the strap ends.

FIG. 1 is a front view of an exemplary embodiment of the present invention having horizontal and vertical perforations (or alternatively referred to as scored or score lines) where the perforations do not extend the entirety of the back of the bag and having an adhesive for connecting the strap ends. Illustrated is a front view of an exemplary embodiment of the present invention illustrating a bag 10 (in a closed condition/position) comprised at least partially of a flexible material. Illustrated for bag 10 is bottom 12, open top 14, plurality of walls/sides 16, 18, 20, 22, slots/perforations 24 (these perforations may be entirely horizontal as illustrated, i.e., parallel to the top and/or bottom of the bag, or orthogonal to the sides of the bag), slots/perforations 25 (these may be entirely vertical in direction as illustrated), bib strap(s) 26, 28 and first attachment mechanism member 30, and second attachment mechanism member 32 (not shown, but may be attached to the other of straps 26, 28 such that it may pair with attachment mechanism 30). Each respective bib strap has a respective bib end 34, 36. At the respective bib strap end, there is an attachment mechanism. In the illustrated embodiment, the mechanism is that of one or more adhesive members such that the adhesive member allows for temporary attachment to another member (i.e., the end of the other strap).

Various methods/mechanisms may be utilized to attach the strap(s)/strap end such as adhesives, slots, tying, buttons, snaps, hook and loop pairings, and, in some embodiments such as that illustrated in FIGS. 36-67 do not require any methods/mechanisms or other means of connecting the strap ends as these embodiments are "tuckable" in that once the straps are separated from the other parts of the bag along the perforations, the user may tuck the straps/strap ends into their shirt, or other article so that the bag is held in position.

The invention may include a pressure sensitive non-drying adhesive portion which allows the strap of the bib to be temporarily attached to one's clothing or another portion of the bag (such as another strap or the bag itself).

Also illustrated is an optional notch 53 in one or more of walls 16, 18, 20, and 22. In this embodiment, perforations 25 extend vertically downward from notch 53 or anywhere in the collar belt.

Figure 2:
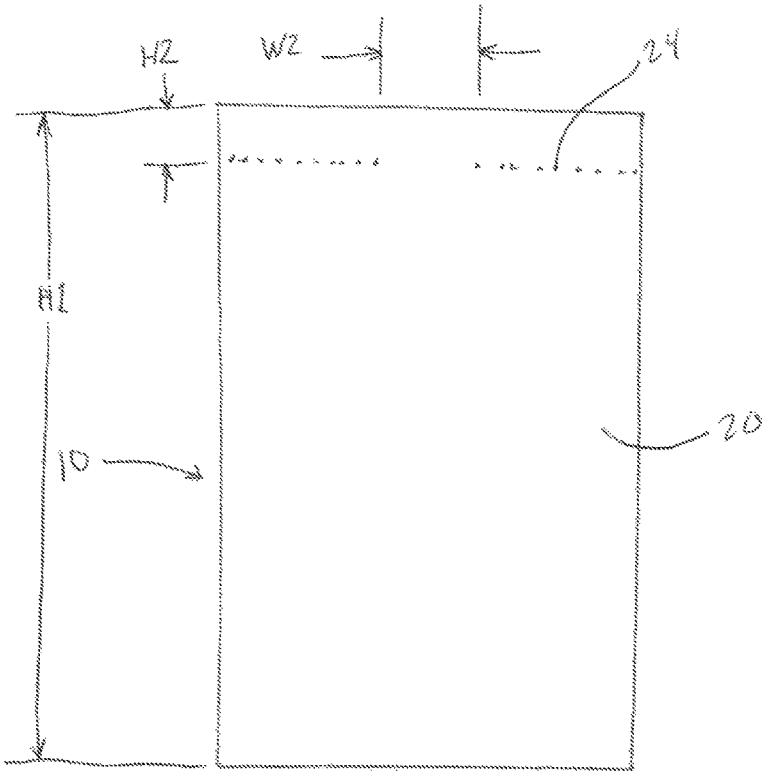
FIG. 2 is a rear view of the embodiment of FIG. 1.

FIG. 2 illustrates a rear view of the exemplary embodiment of FIG. 1. Illustrated is a front view of bag 10, showing a set of dimensions for bag 10: H1 is the overall the height, H2 is length from the top of the bag to the horizontal perforations, and W2 is a length of "non-perforated" bag/material.

Figure 3:
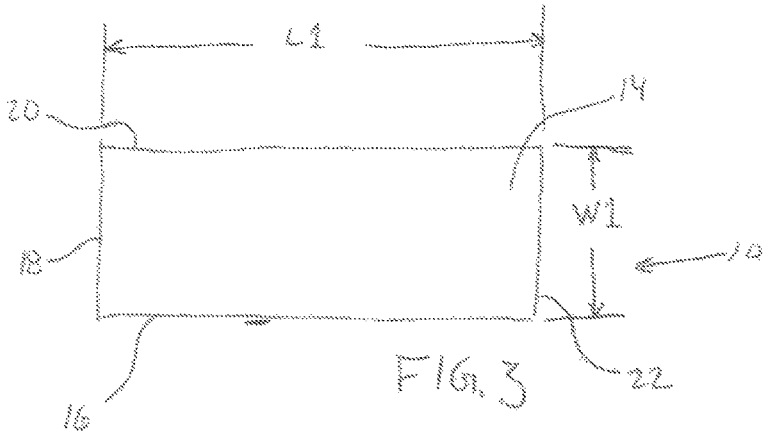
FIG. 3 is a top view of the embodiment of FIG. 1.

FIG. 3 is a top view of the embodiment of FIG. 1. This view illustrates other dimensions of bag 10, to wit, W1 is the overall width of bag 10. Thus, a perimeter of bag 10 is calculated as $2\times L1+2\times W1=P$ (perimeter).

Figure 4:
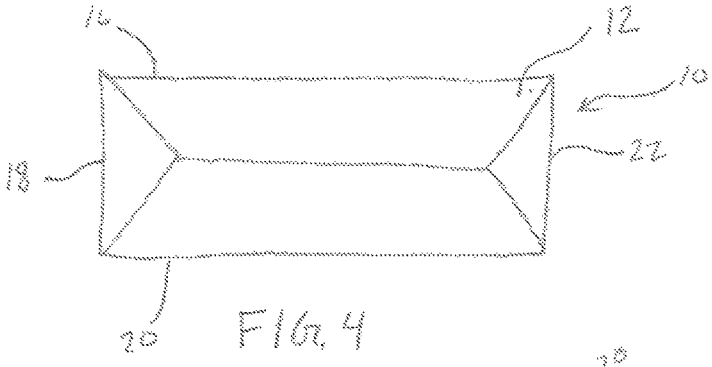
FIG. 4 is a bottom view of the embodiment of FIG. 1.

FIG. 4 is a bottom view of the embodiment of FIG. 1.

Figure 5:
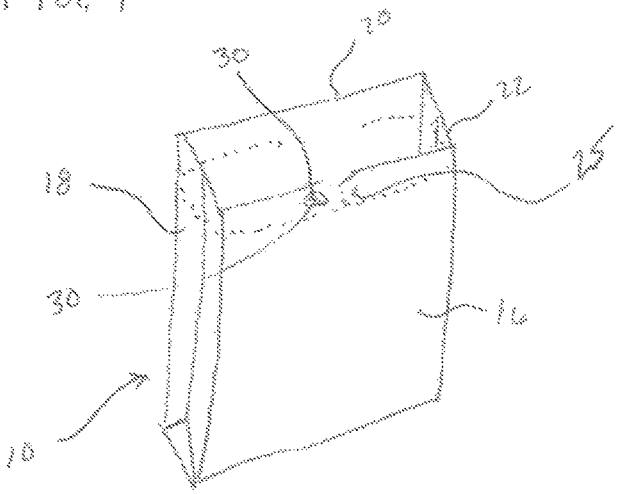
FIG. 5 is a perspective view of the embodiment of FIG. 1.

FIG. 5 is a perspective view of the embodiment of FIG. 1. This view illustrates that each of sides 16, 18, 20, and 22 is at least partially perforated (in this embodiment, only side 20 is partially perforated over its entirety and sides 16, 18, 22 each have a horizontally perforated line over their entirety.

In this embodiment, the ratio of W2 to P is between 0.05 and 0.30. This ratio is important because it allows for sufficient length of the straps to perform their functions, yet still allows for enough material (W2) to allow secure connection between the straps and the rest of bag 10.

In some embodiments, the ratio of W2/P is between 0.08 and 0.20. In some embodiments, the ratio is between 0.10 and 0.15.

For example, in one embodiment, W2 is 3 inches, and P is 23 inches for a ratio of 0.130. In this example, H1 may be approximately equal to 11⅜ inches, L1 is approximately equal to 6¾ inches, and W1 is approximately 4¾ inches. In some embodiments, H2 is less than or equal to ¼ of H1. In some embodiments, H2 is between 0.25 inches and 3 inches. In some embodiments, H2 is between 0.5 inches and 1.5 inches. Perforations/slots 24, 25 may be of any suitable configuration including, but not limited to, slots, holes, and indentations. In some embodiments, W2 is greater than or equal to one inch.

Figure 69:
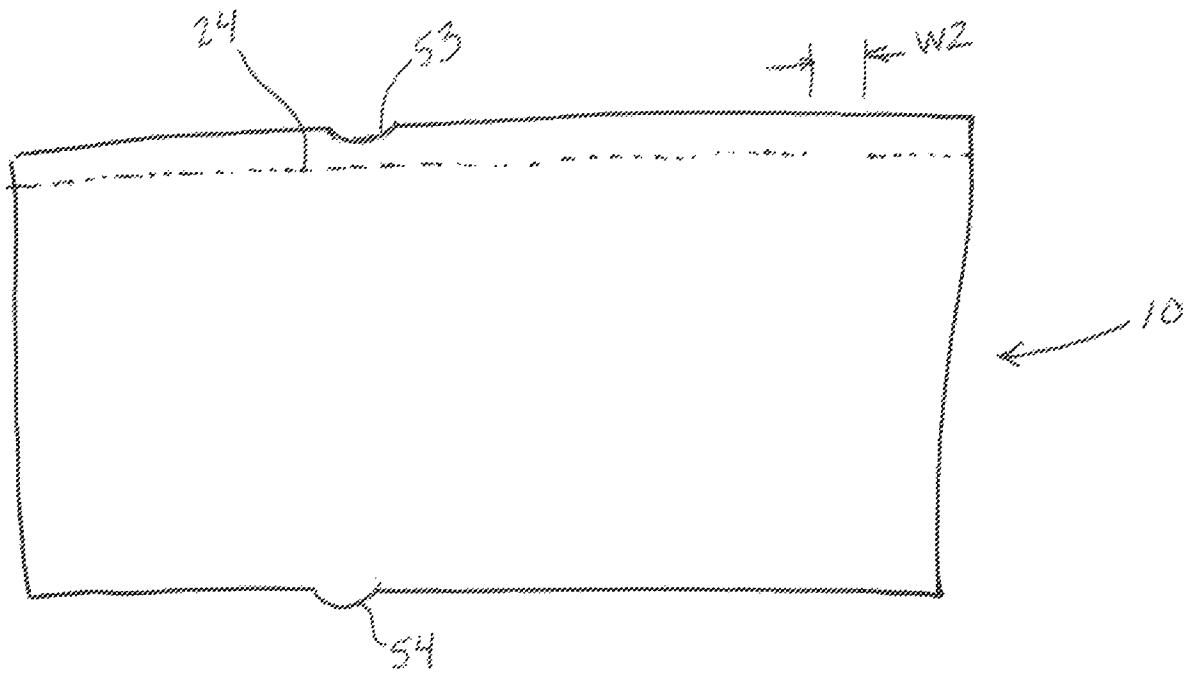
FIG. 69 is a front view of an exemplary embodiment of the present invention in a flat configuration prior to being placed into a bag configuration which illustrates an exemplary perforation line as well as a non-perforated portion.

When bags are manufactured, they are often constructed as flat sheets and then cut out as illustrated in FIG. 69. Thus, bags are in at least three conditions/configuration in their lifetime, flat sheets as in FIG. 69, assembled, but laying collapsed as in FIG. 6A (such as it would be for shipping and at the restaurant prior to being needed/expanded), and opened for use in holding food (or other) articles as in FIG. 5.

Figure 6A:
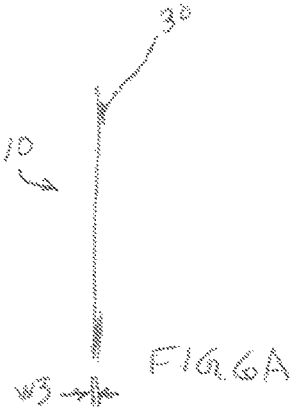
FIG. 6A is a side view of the embodiment of FIG. 1 with the bottom/lower portion in a closed condition.

FIG. 6A is a side view of the embodiment of FIG. 1 with the bottom/lower portion in a closed condition. This illustrates a location for mechanism 30. In this embodiment, the mechanism 30 is an adhesive portion which may or may not have a removable plastic shield protecting the adhesive. The mechanism 30 may be on the outside or inside of bag 10 as the particular embodiment may vary. Also illustrated in FIG. 6A is W3 which is a representation of how far the lower portion of the bag extends in front of side 16 (this lower portion of the bag including bottom 12 is referred to herein as a foot). This is a useful dimension as it illustrates that there is a foot/portion of the bag which extends outward from side 16 to catch debris, sauce, etc. Thus, the foot may be pulled/kicked out/opened, etc. as in FIG. 6B. Ultimately, if the foot keeps being kicked out, the bag becomes opened.

Figure 6B:
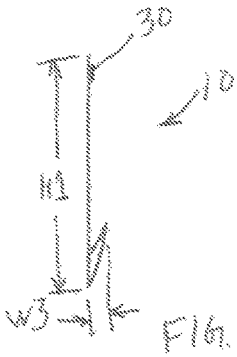
FIG. 6B is a side view of the embodiment of FIG. 1 with the bottom/lower portion in a partially opened condition.

FIG. 6B is a side view of the embodiment of FIG. 1 with the bottom/lower portion in a partially opened condition. This illustrates W3 such that the lower portion of the bag extends a reasonable distance from the plane (or approximate plane) of side 16 (as the bag is flexible, side 16 is not limited to being planar, but what is noted is that the lower portion (including at least a portion of side 12 extends outward to present a shelf/catch/slot/etc. to catch falling debris/sauce/etc.

Figure 7:
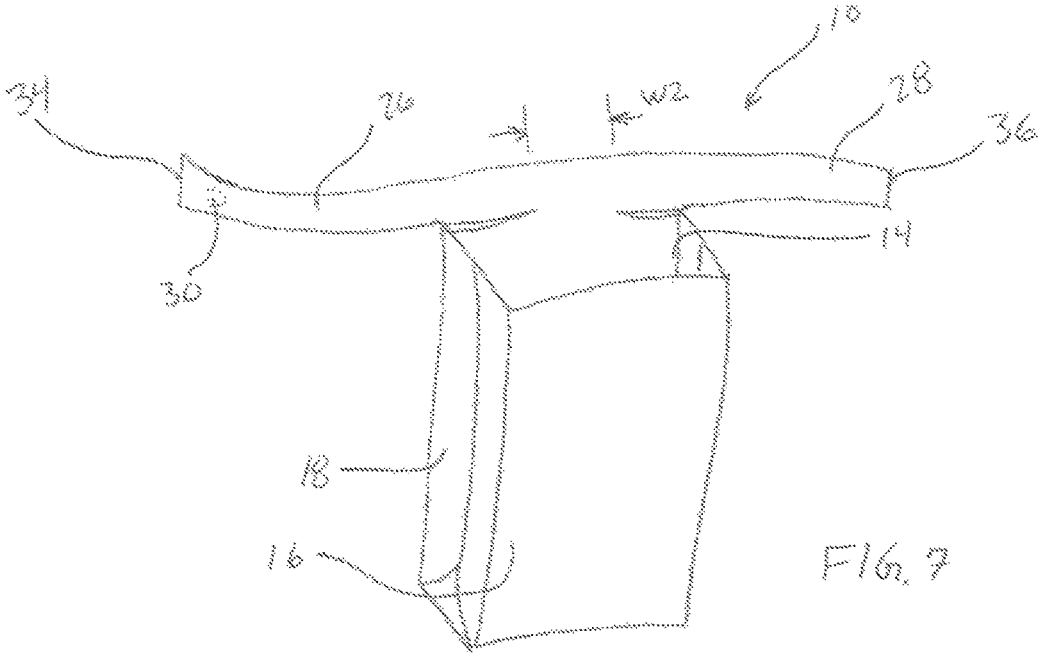
FIG. 7 is a perspective view of the embodiment of FIG. 1 with the straps removed along the perforations and with the straps extended and the bag opened.

FIG. 7 is a perspective view of the embodiment of FIG. 1 with the straps removed along the perforations and with the straps extended and the bag opened. Note that straps 26, 28 have been separated from portions of bag 10 along perforations 24, 25 such that the straps extend outwardly from bag 10. Also note that although mechanism 30 is illustrated in this embodiment as being on the side away from the viewer, it may also be on the side of the viewer. So long as the mechanism allows a person to connect the strap ends to each other around the wearer's neck, the mechanism's exact location is variable.

Figure 8:
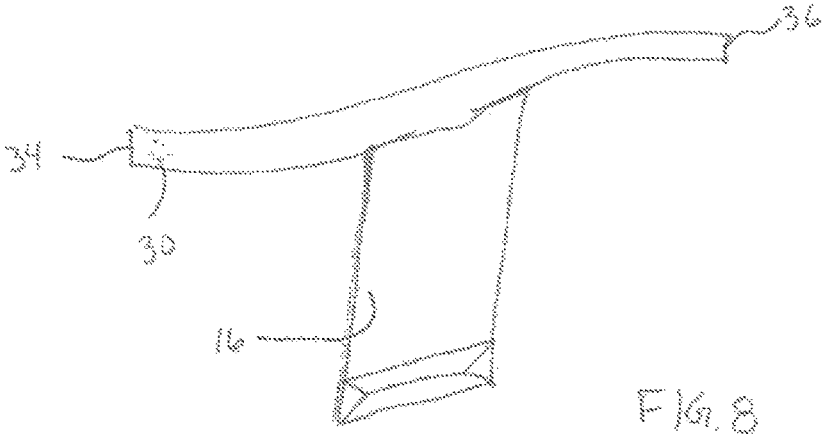
FIG. 8 is a perspective view of the embodiment of FIG. 1 with the straps removed along the perforations and with the straps extended and the bag closed.

FIG. 8 is a perspective view of the embodiment of FIG. 1 with the straps removed along the perforations and with the straps extended and the bag closed.

Figure 9:
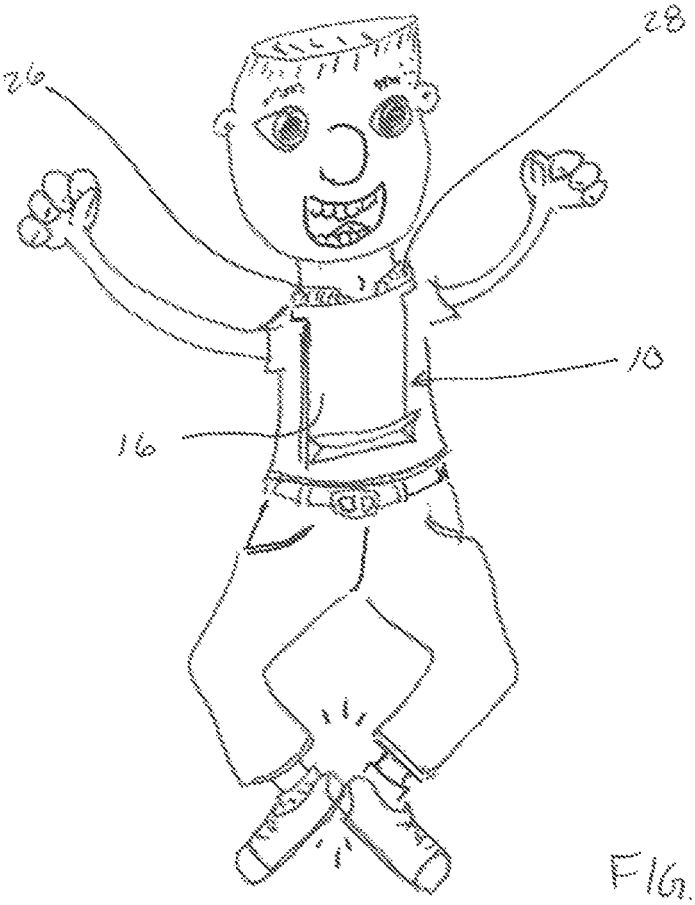
FIG. 9 is a perspective view of the embodiment of FIG. 1 in use by a person with the bag in a mostly closed, but partially open position to catch debris.

FIG. 9 is a perspective view of the embodiment of FIG. 1 in use by a person with the bag in a mostly closed, but partially open position to catch debris. In this configuration/condition/position, the lower portion of the bag extends at least a little away from the other portions such that when a person/user is eating, this portion of the bag may catch debris from the food article, etc. This is particularly useful if the food article has sauce in/on it that could spill/leak, etc.

Note that although this embodiment is illustrated as having two straps, it could function similarly if there were a single longer strap. Such versions are within the scope of the present invention.

Figure 10:
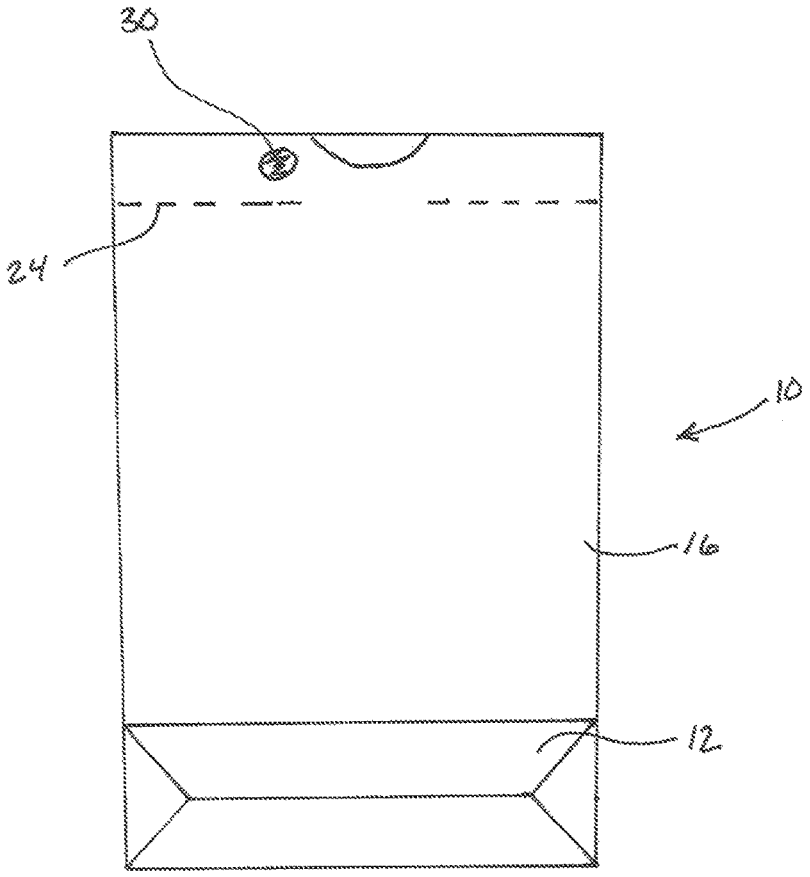
FIG. 10 is a front view of another exemplary embodiment of the present invention having horizontal perforations and an adhesive for connection of the strap ends and wherein the perforations do not extend the entirety of the front of the bag.
Figure 11:
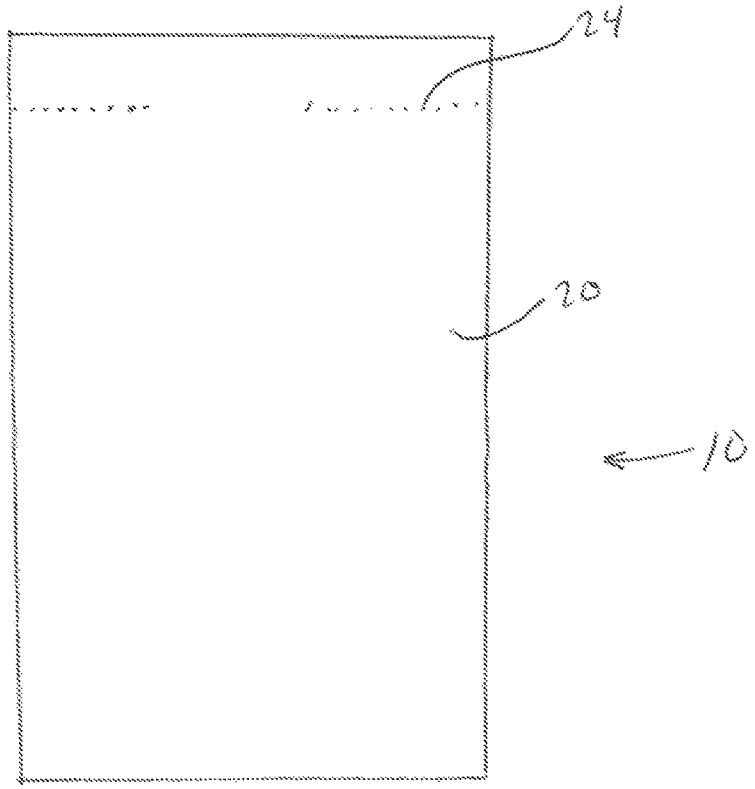
FIG. 11 is a rear view of the embodiment of FIG. 10.
Figure 12:
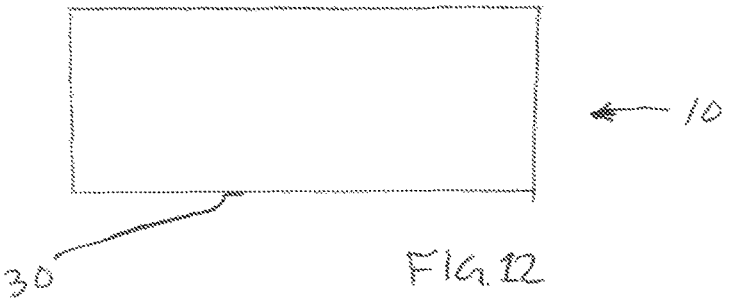
FIG. 12 is a top view of the embodiment of FIG. 10.
Figure 15:
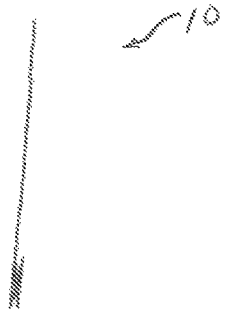
FIG. 15 is a side view of the embodiment of FIG. 10.
Figure 13:
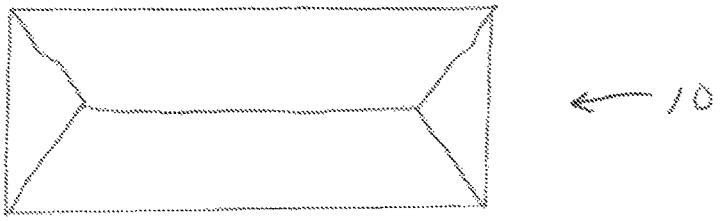
FIG. 13 is a bottom view of the embodiment of FIG. 10.
Figure 14:
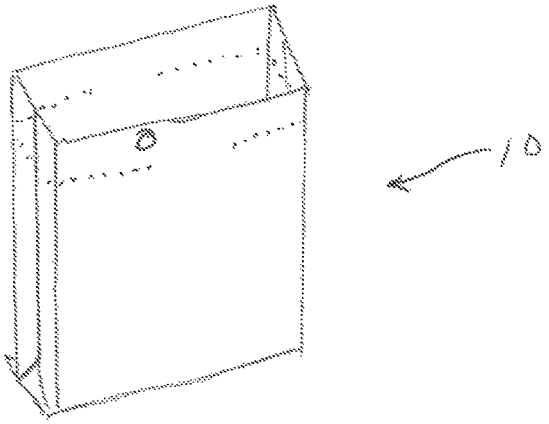
FIG. 14 is a perspective view of the embodiment of FIG. 10.
Figure 16:
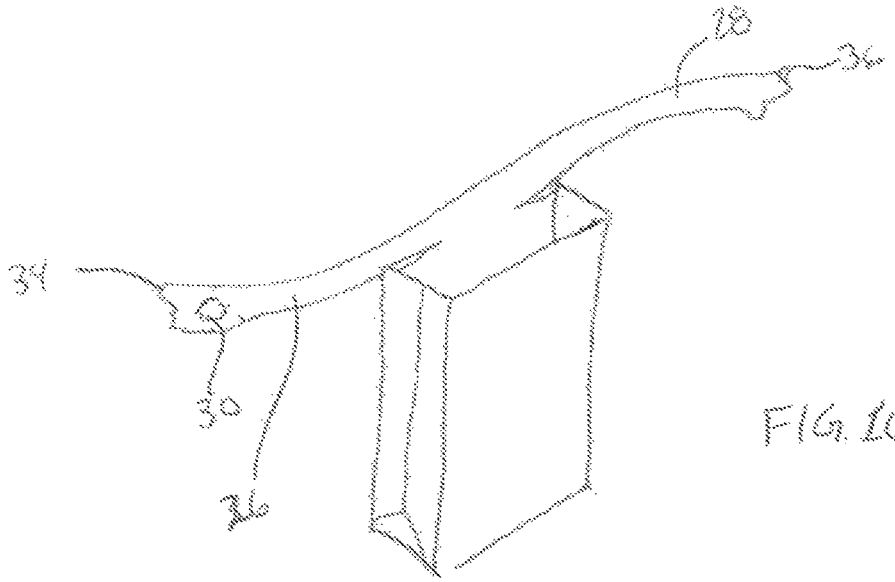
FIG. 16 is a perspective view of the embodiment of FIG. 10 with the straps removed along the perforations and with the straps extended and the bag opened.
Figure 17:
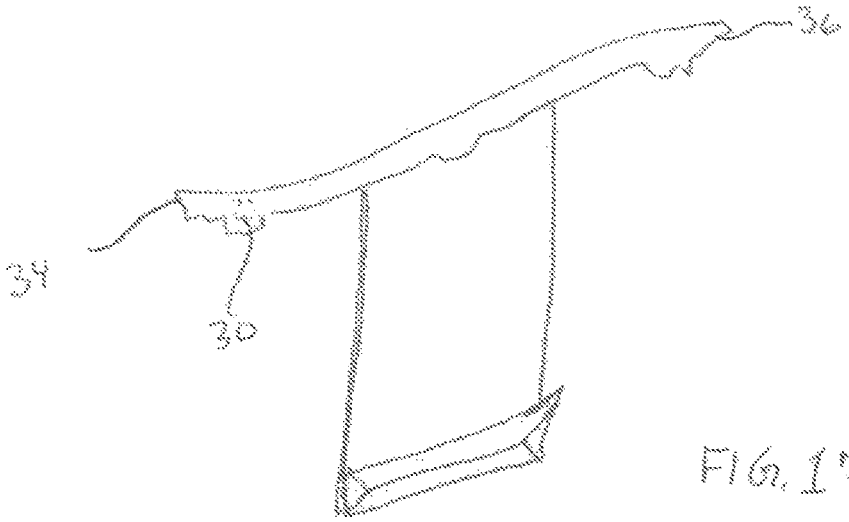
FIG. 17 is a perspective view of the embodiment of FIG. 10 with the straps removed along the perforations and with the straps extended and the bag closed.
Figure 18:
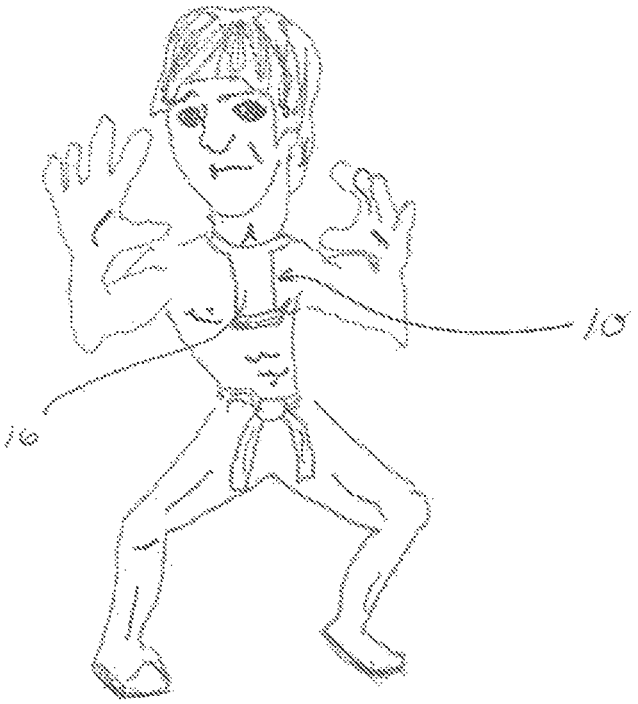
FIG. 18 is a perspective view of the embodiment of FIG. 10 in use by a person with the bag in a mostly closed, but partially open position to catch debris.

FIG. 10 is a front view of another exemplary embodiment of the present invention having horizontal perforations and an adhesive for connection of the strap ends and wherein the perforations do not extend the entirety of the front of the bag. FIG. 11 is a rear view of the embodiment of FIG. 10. FIG. 12 is a top view of the embodiment of FIG. 10. FIG. 13 is a bottom view of the embodiment of FIG. 10. FIG. 14 is a perspective view of the embodiment of FIG. 10. FIG. 15 is a side view of the embodiment of FIG. 10. FIG. 16 is a perspective view of the embodiment of FIG. 10 with the straps removed along the perforations and with the straps extended and the bag opened. FIG. 17 is a perspective view of the embodiment of FIG. 10 with the straps removed along the perforations and with the straps extended and the bag closed. FIG. 18 is a perspective view of the embodiment of FIG. 10 in use by a person with the bag in a mostly closed, but partially open position to catch debris.

Figure 19:
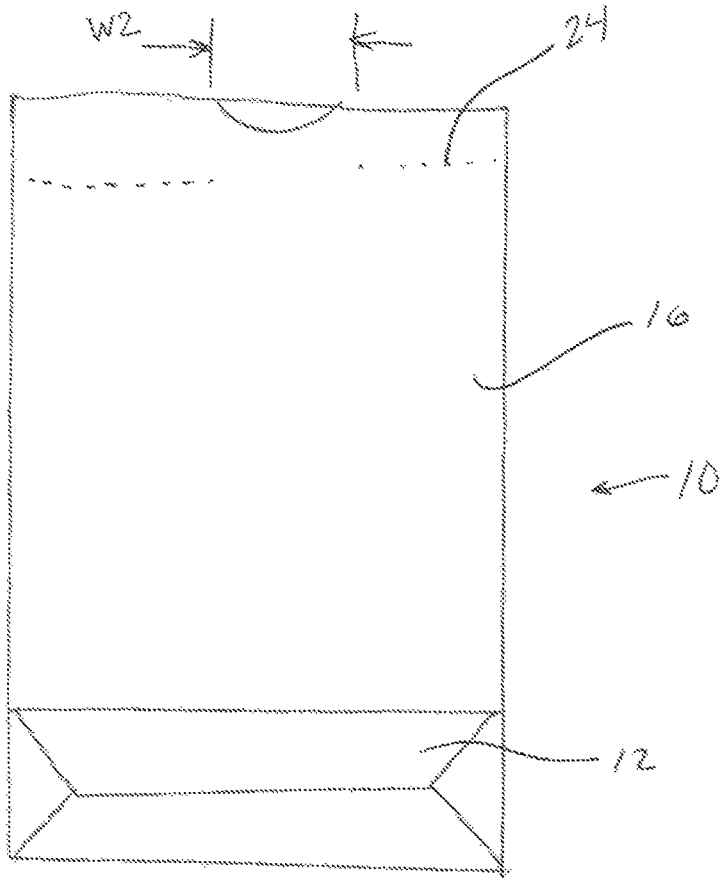
FIG. 19 is a front view of an exemplary embodiment of the present invention having horizontal perforations and an adhesive for connection of the two strap ends and wherein the perforations do not extend the entirety of the front of the bag.
Figure 20:
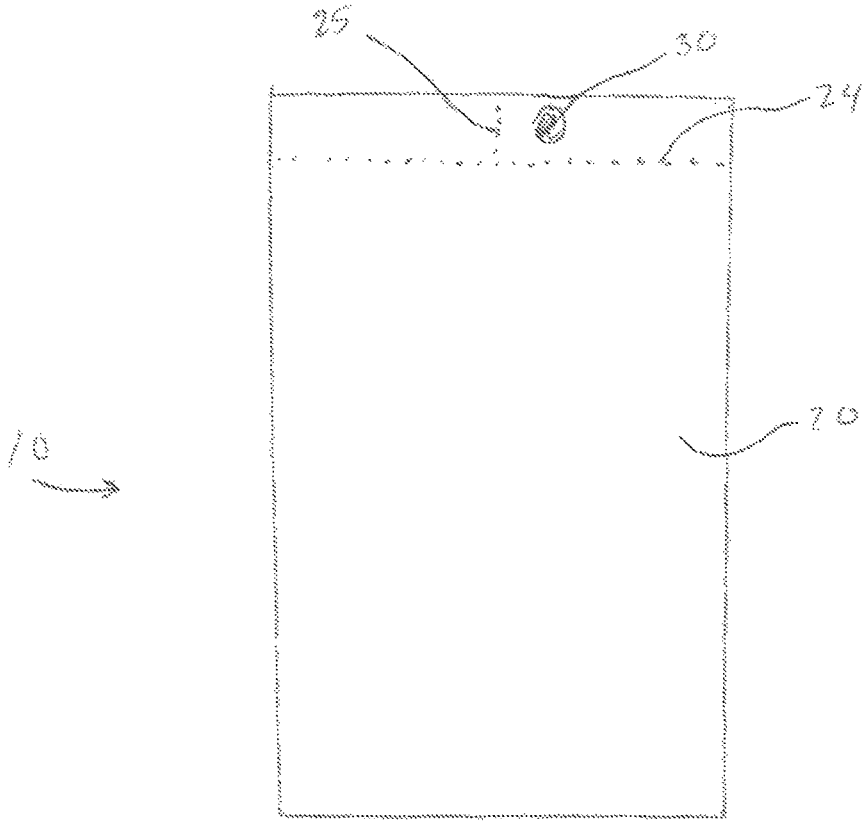
FIG. 20 is a rear view of the embodiment of FIG. 19.
Figure 21:
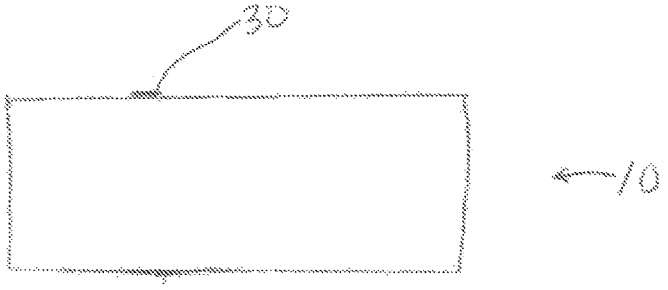
FIG. 21 is a top view of the embodiment of FIG. 19.
Figure 24:
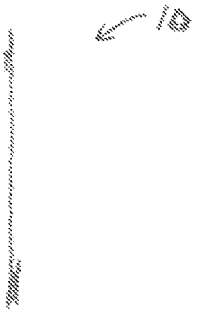
FIG. 24 is a side view of the embodiment of FIG. 19.
Figure 22:
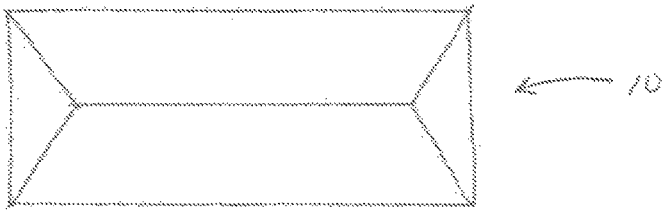
FIG. 22 is a bottom view of the embodiment of FIG. 19.
Figure 23:
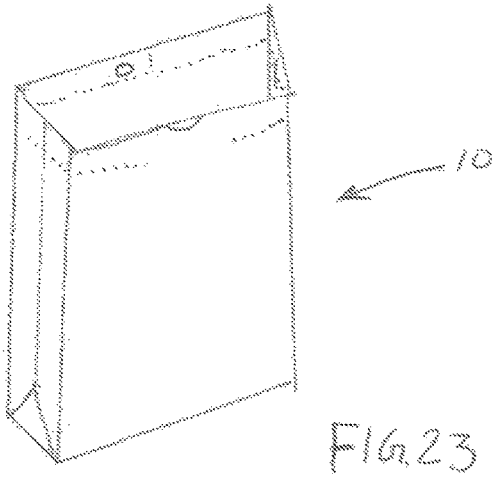
FIG. 23 is a perspective view of the embodiment of FIG. 19.
Figure 25:
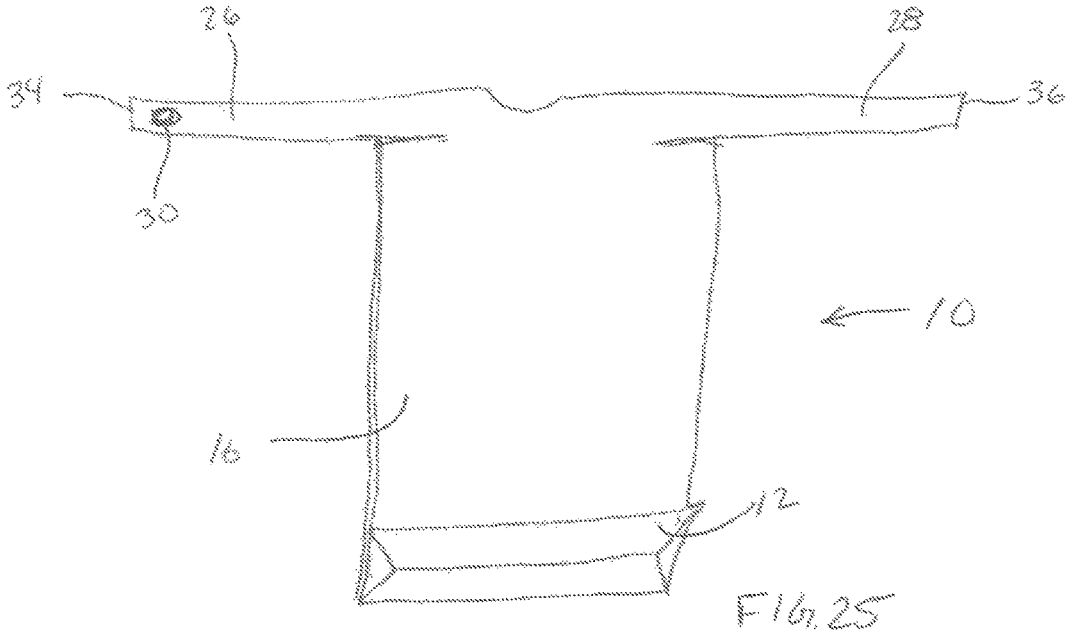
FIG. 25 is a perspective view of the embodiment of FIG. 19 with the straps removed along the perforations and with the straps extended and the bag closed.

FIG. 19 is a front view of an exemplary embodiment of the present invention having horizontal perforations and an adhesive for connection of the two strap ends and wherein the perforations do not extend the entirety of the front of the bag. FIG. 20 is a rear view of the embodiment of FIG. 19. FIG. 21 is a top view of the embodiment of FIG. 19. FIG. 22 is a bottom view of the embodiment of FIG. 19. FIG. 23 is a perspective view of the embodiment of FIG. 19. FIG. 24 is a side view of the embodiment of FIG. 19. FIG. 25 is a perspective view of the embodiment of FIG. 19 with the straps removed along the perforations and with the straps extended and the bag closed.

Figure 26:
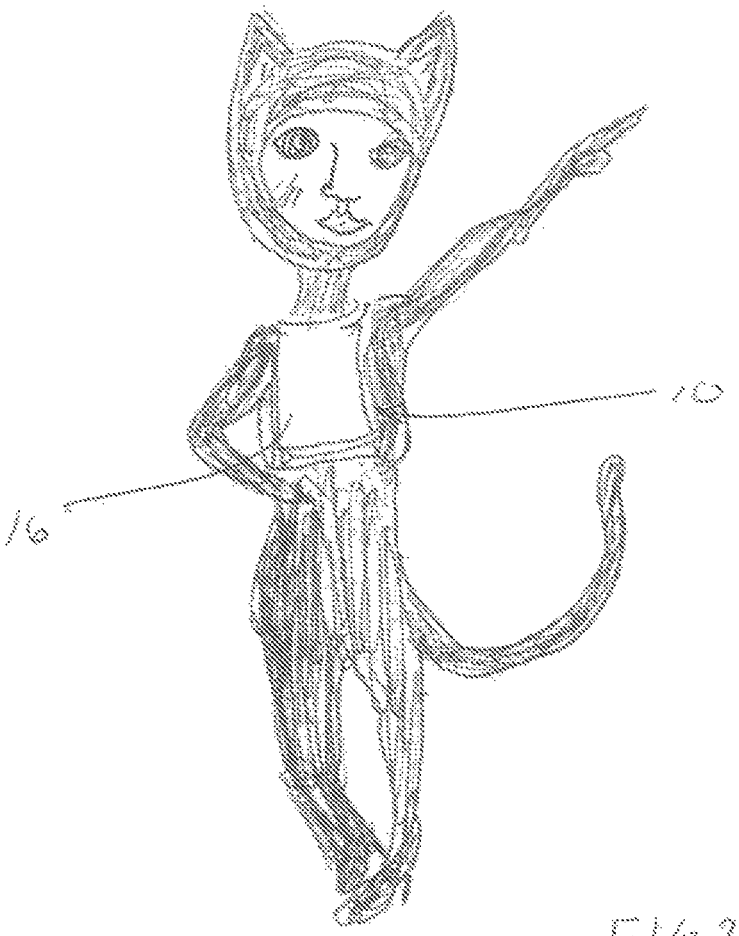
FIG. 26 is a perspective view of the embodiment of FIG. 19 in use by a person with the bag in a mostly closed, but partially open position to catch debris.
Figure 27:
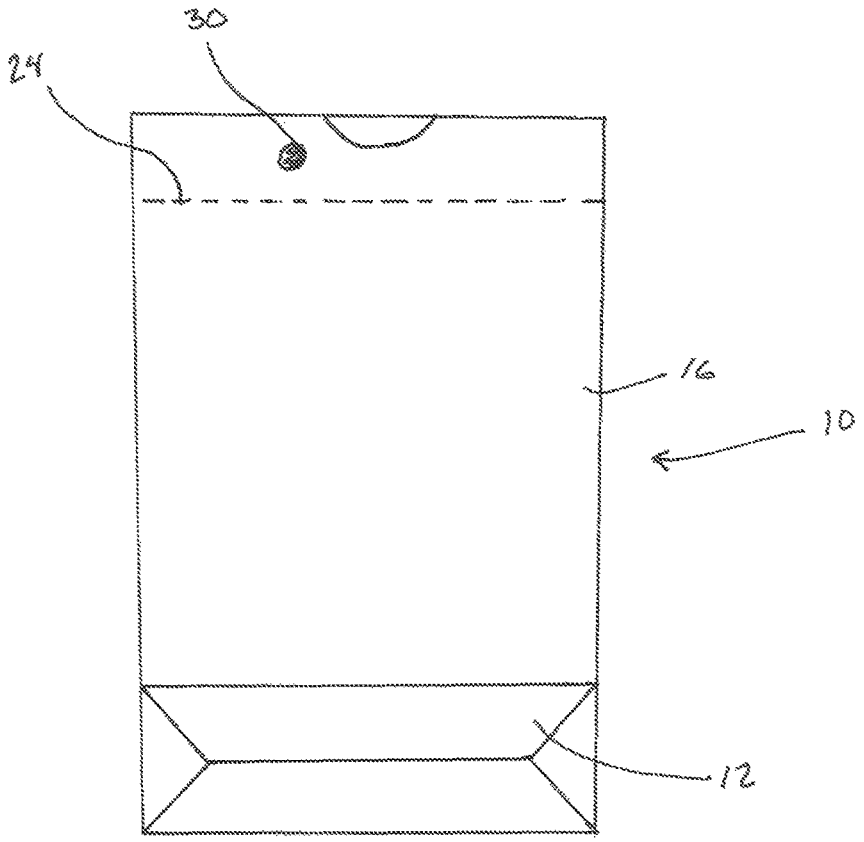
FIG. 27 is a front view of an exemplary embodiment of the present invention having horizontal and vertical perforations and an adhesive for connection of the two strap ends and the perforations do not extend the entirety of the back of the bag.
Figure 28:
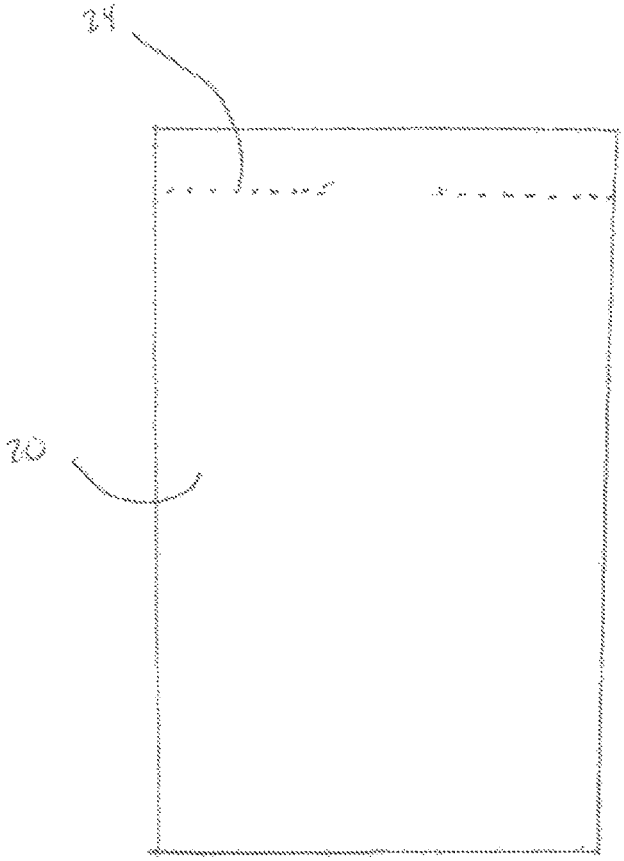
FIG. 28 is a rear view of the embodiment of FIG. 27.
Figure 29:
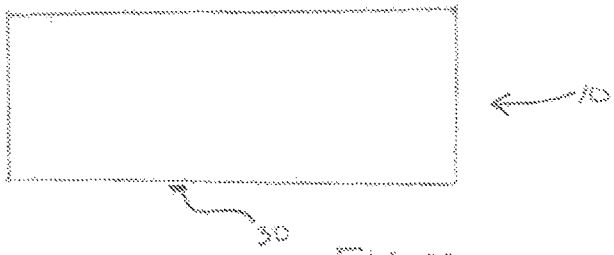
FIG. 29 is a top view of the embodiment of FIG. 27.
Figure 32:
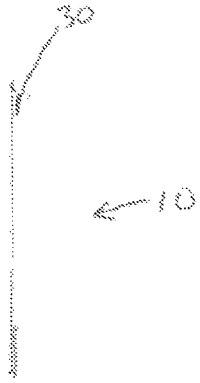
FIG. 32 is a side view of the embodiment of FIG. 27.
Figure 30:
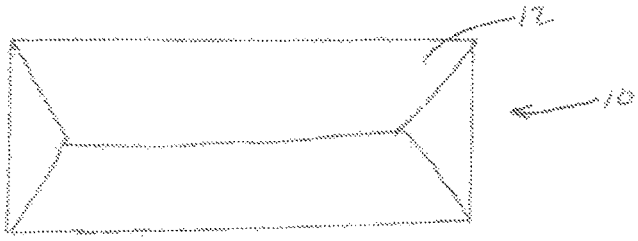
FIG. 30 is a bottom view of the embodiment of FIG. 27.
Figure 31:
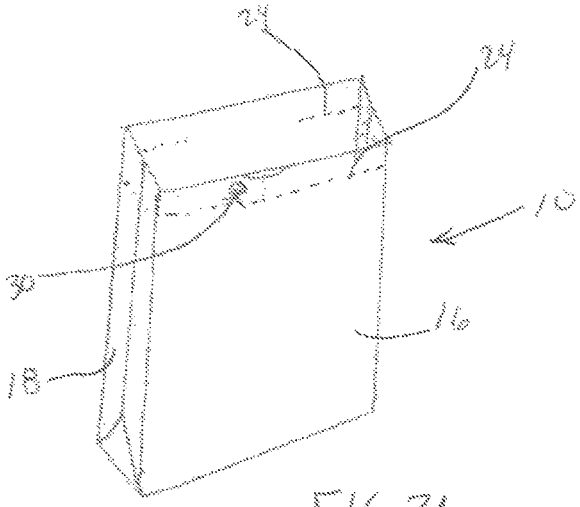
FIG. 31 is a perspective view of the embodiment of FIG. 27.
Figure 33:
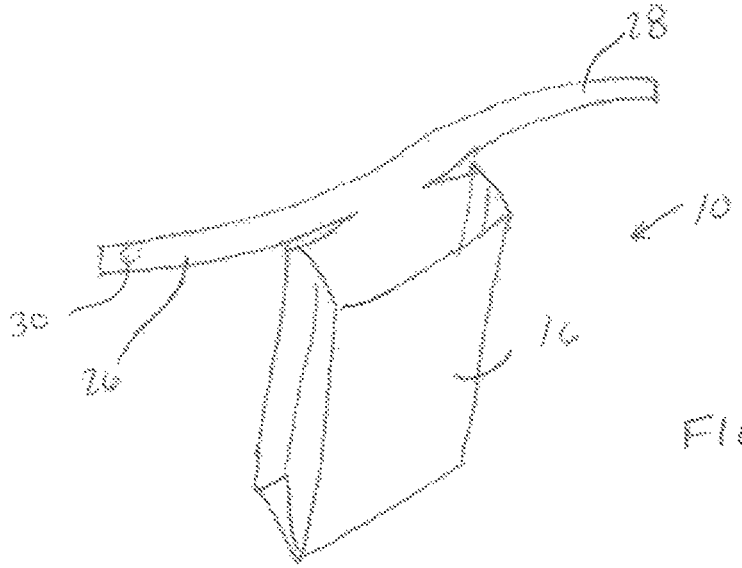
FIG. 33 is a perspective view of the embodiment of FIG. 27 with the straps removed along the perforations and with the straps extended and the bag opened.
Figure 34:
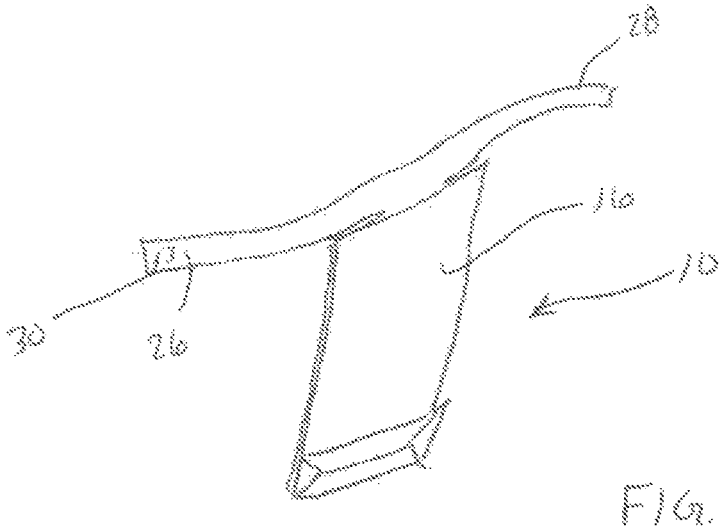
FIG. 34 is a perspective view of the embodiment of FIG. 27 with the straps removed along the perforations and with the straps extended and the bag closed.
Figure 35:
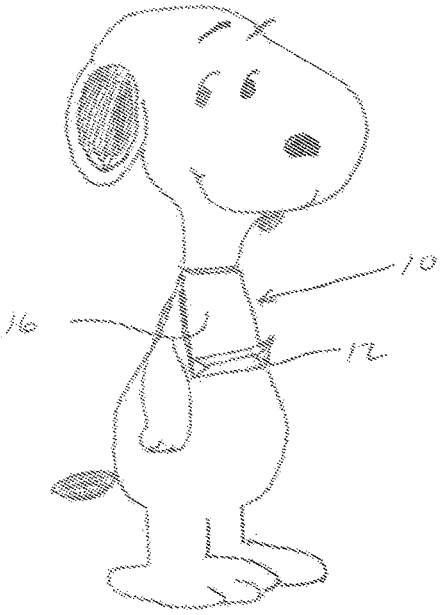
FIG. 35 is a perspective view of the embodiment of FIG. 27 in use by a person with the bag in a mostly closed, but partially open position to catch debris.

FIG. 26 is a perspective view of the embodiment of FIG. 19 in use by a person with the bag in a mostly closed, but partially open position to catch debris. FIG. 27 is a front view of an exemplary embodiment of the present invention having horizontal and vertical perforations and an adhesive for connection of the two strap ends and the perforations do not extend the entirety of the back of the bag. FIG. 28 is a rear view of the embodiment of FIG. 27. FIG. 29 is a top view of the embodiment of FIG. 27. FIG. 30 is a bottom view of the embodiment of FIG. 27. FIG. 31 is a perspective view of the embodiment of FIG. 27. FIG. 32 is a side view of the embodiment of FIG. 27. FIG. 33 is a perspective view of the embodiment of FIG. 27 with the straps removed along the perforations and with the straps extended and the bag opened. FIG. 34 is a perspective view of the embodiment of FIG. 27 with the straps removed along the perforations and with the straps extended and the bag closed. FIG. 35 is a perspective view of the embodiment of FIG. 27 in use by a person with the bag in a mostly closed, but partially open position to catch debris.

Figure 36:
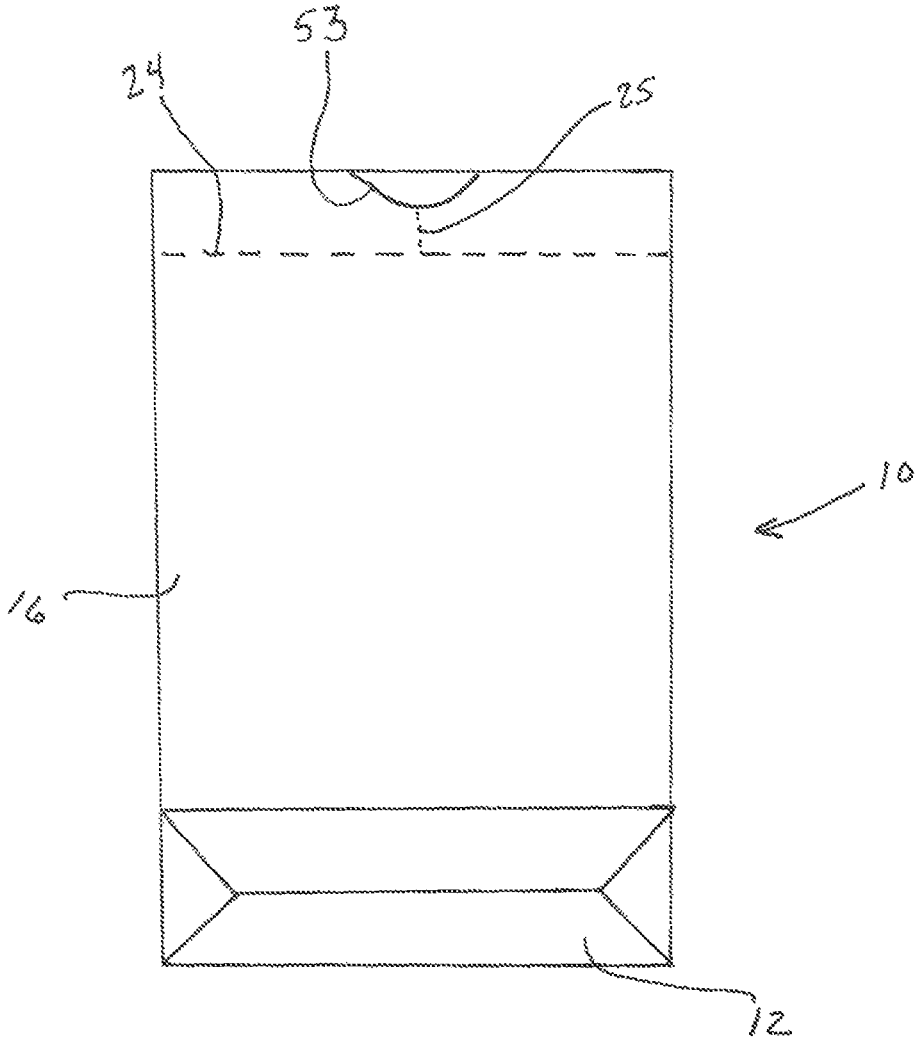
FIG. 36 is a front view of an exemplary embodiment of the present invention having horizontal and vertical perforations with the perforations not extending across the entirety of the back of the bag and it is a tuckable version with no adhesive.
Figure 37:
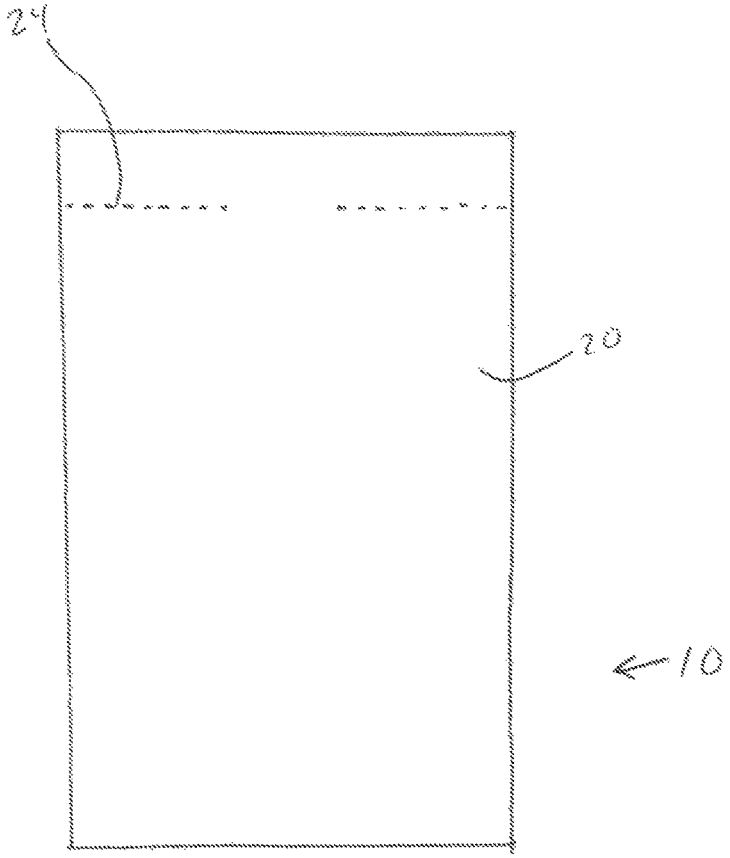
FIG. 37 is a rear view of the embodiment of FIG. 36.
Figure 38:
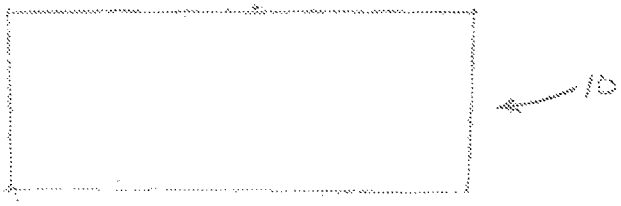
FIG. 38 is a top view of the embodiment of FIG. 36.
Figure 41:
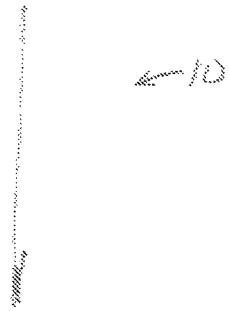
FIG. 41 is a side view of the embodiment of FIG. 36.
Figure 39:
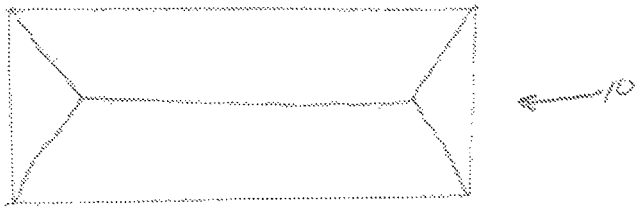
FIG. 39 is a bottom view of the embodiment of FIG. 36.
Figure 40:
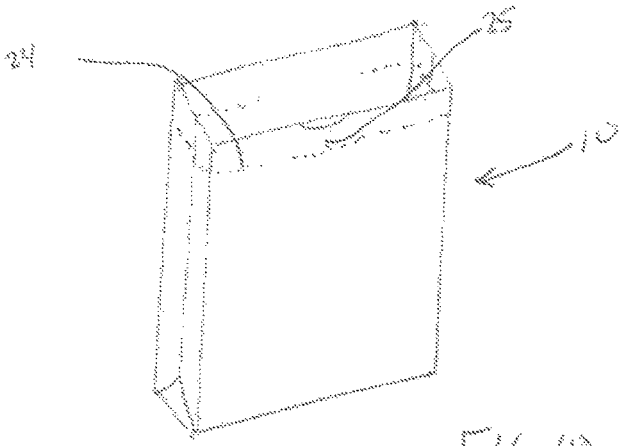
FIG. 40 is a perspective view of the embodiment of FIG. 36.
Figure 42:
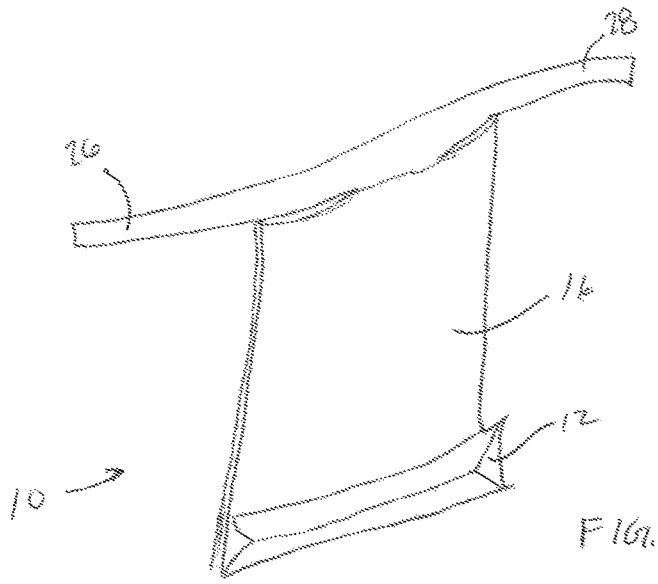
FIG. 42 is a perspective view of the embodiment of FIG. 36 with the straps removed along the perforations and with the straps extended and the bag closed.
Figure 43:
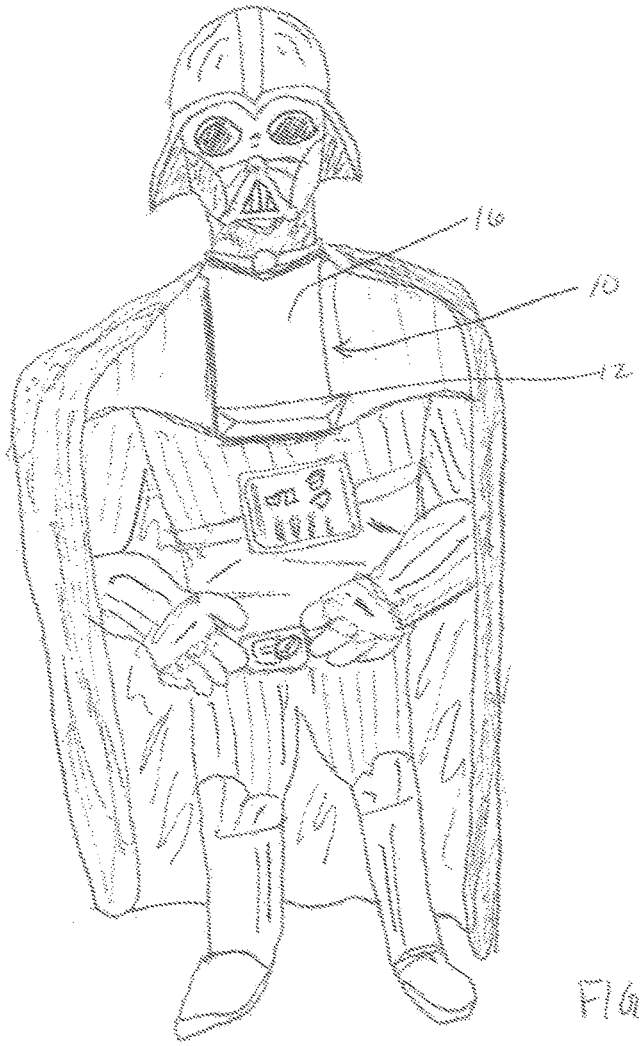
FIG. 43 is a perspective view of the embodiment of FIG. 36 in use by a person with the bag in a mostly closed, but partially open position to catch debris.

FIG. 36 is a front view of an exemplary embodiment of the present invention having horizontal and vertical perforations with the perforations not extending across the entirety of the back of the bag and it is a tuckable version with no adhesive (though the perforations may be of any configuration including, but not limited to, straight, curved, angled, and saw tooth). Note that in this embodiment, there may be a single strap which extends from bag 10 or two straps as illustrated. FIG. 37 is a rear view of the embodiment of FIG. 36. FIG. 38 is a top view of the embodiment of FIG. 36. FIG. 39 is a bottom view of the embodiment of FIG. 36. FIG. 40 is a perspective view of the embodiment of FIG. 36. FIG. 41 is a side view of the embodiment of FIG. 36. FIG. 42 is a perspective view of the embodiment of FIG. 36 with the straps removed along the perforations and with the straps extended and the bag closed. FIG. 43 is a perspective view of the embodiment of FIG. 36 in use by a person with the bag in a mostly closed, but partially open position to catch debris.

Figure 44:
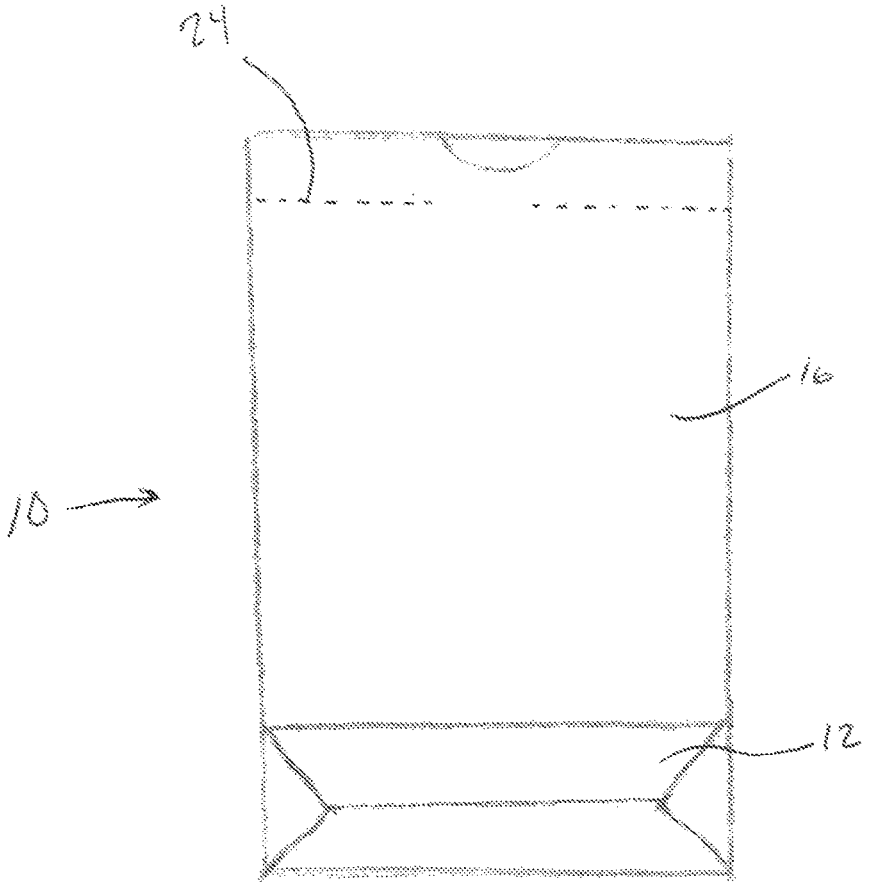
FIG. 44 is a front view of an exemplary embodiment of the present invention having horizontal perforations that extend only partway across the front and rear of the bag but not all the way across the back of the bag and there is no adhesive, it is a tuckable version.
Figure 45:
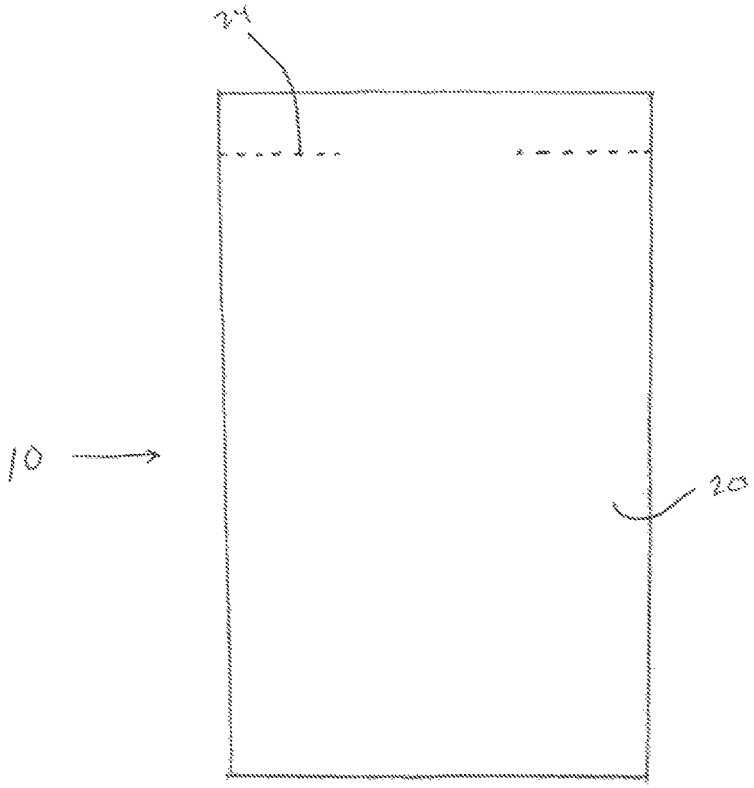
FIG. 45 is a rear view of the embodiment of FIG. 44.
Figure 46:
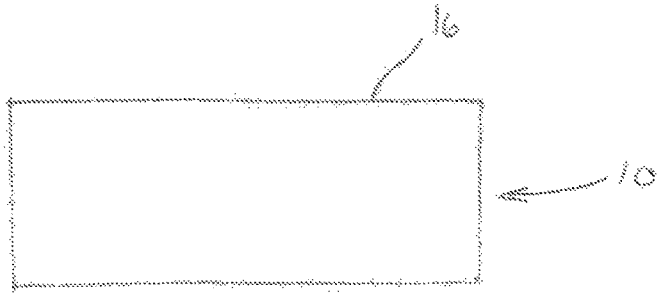
FIG. 46 is a top view of the embodiment of FIG. 44.
Figure 49:
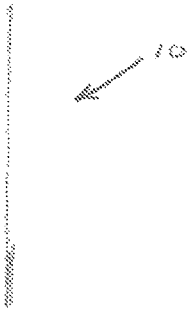
FIG. 49 is a side view of the embodiment of FIG. 44.
Figure 47:
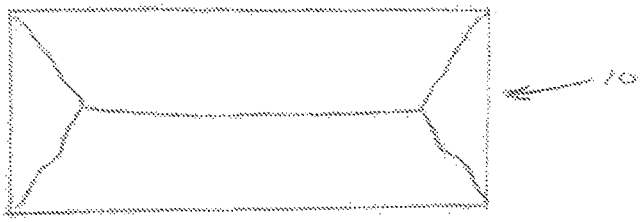
FIG. 47 is a bottom view of the embodiment of FIG. 44.
Figure 48:
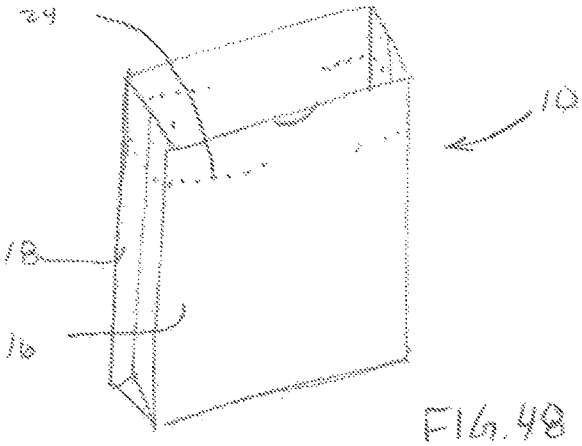
FIG. 48 is a perspective view of the embodiment of FIG. 44.
Figure 50:
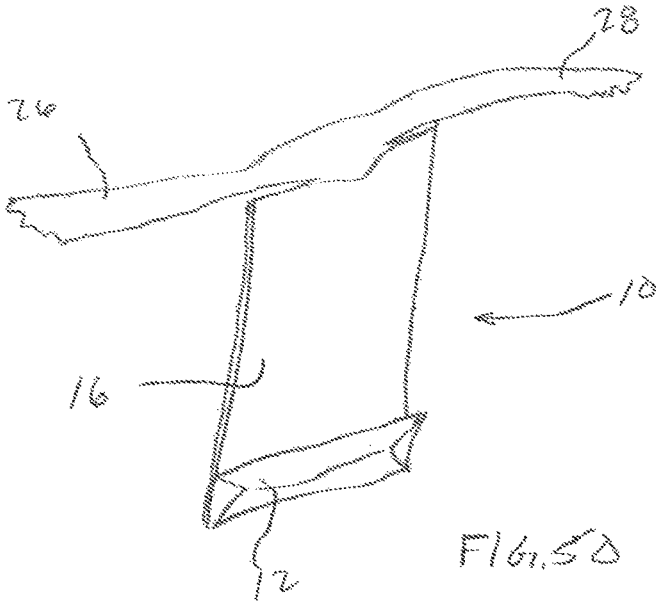
FIG. 50 is a perspective view of the embodiment of FIG. 44 with the straps removed along the perforations and with the straps extended and the bag closed.
Figure 51:
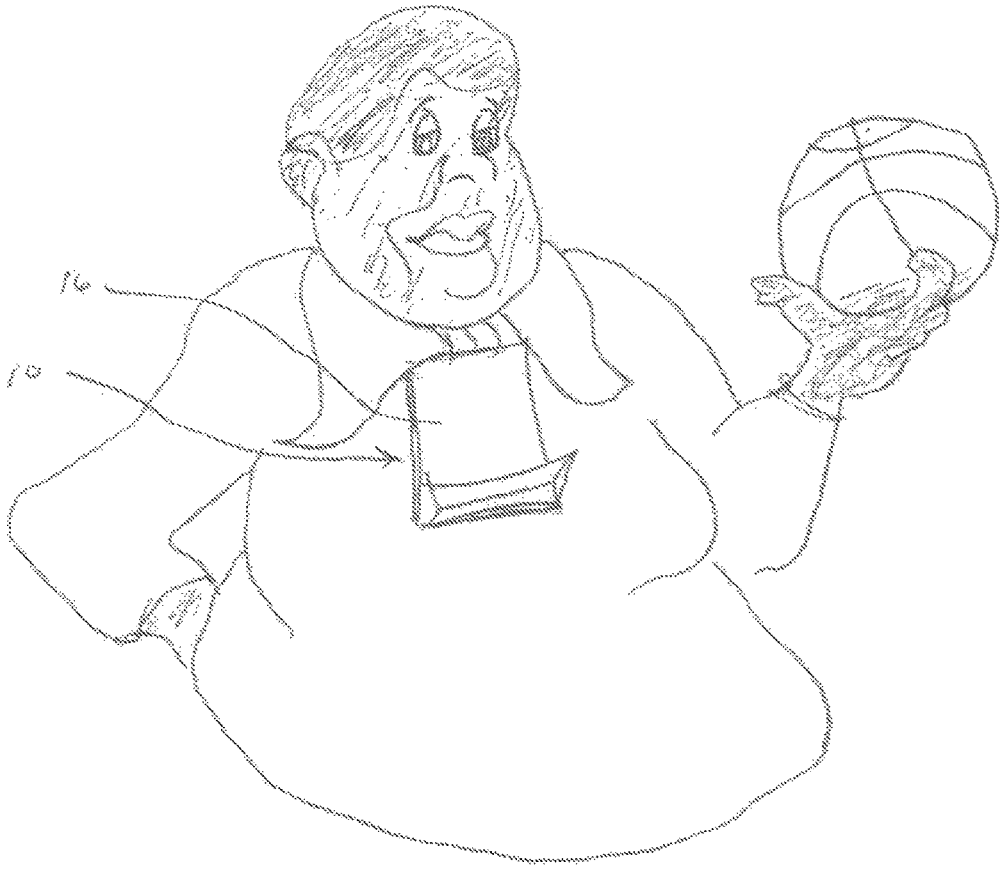
FIG. 51 is a perspective view of the embodiment of FIG. 44 in use by a person with the bag in a mostly closed, but partially open position to catch debris.

FIG. 44 is a front view of an exemplary embodiment of the present invention having horizontal perforations that extend only partway across the front and rear of the bag but not all the way across the back of the bag and there is no adhesive, it is a tuckable version! FIG. 45 is a rear view of the embodiment of FIG. 44. FIG. 46 is a top view of the embodiment of FIG. 44. FIG. 47 is a bottom view of the embodiment of FIG. 44. FIG. 48 is a perspective view of the embodiment of FIG. 44. FIG. 49 is a side view of the embodiment of FIG. 44. FIG. 50 is a perspective view of the embodiment of FIG. 44 with the straps removed along the perforations and with the straps extended and the bag closed. FIG. 51 is a perspective view of the embodiment of FIG. 44 in use by a person with the bag in a mostly closed, but partially open position to catch debris.

Figure 52:
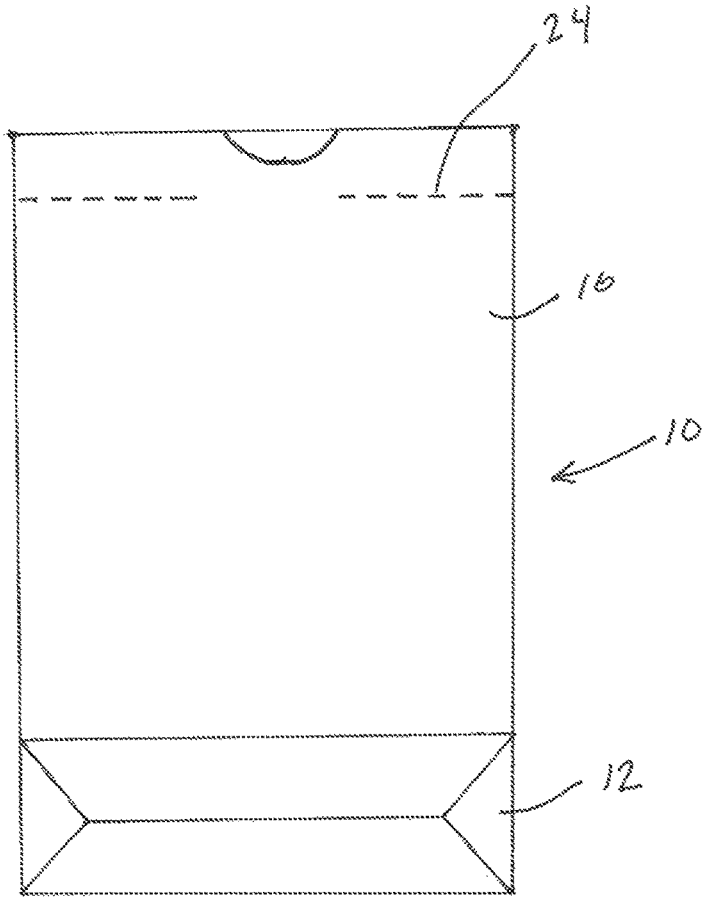
FIG. 52 is a front view of an exemplary embodiment of the present invention having horizontal and vertical perforations that extend all the way across the rear of the bag but not all the way across the front of the bag and there is no adhesive, it is a tuckable version.
Figure 53:
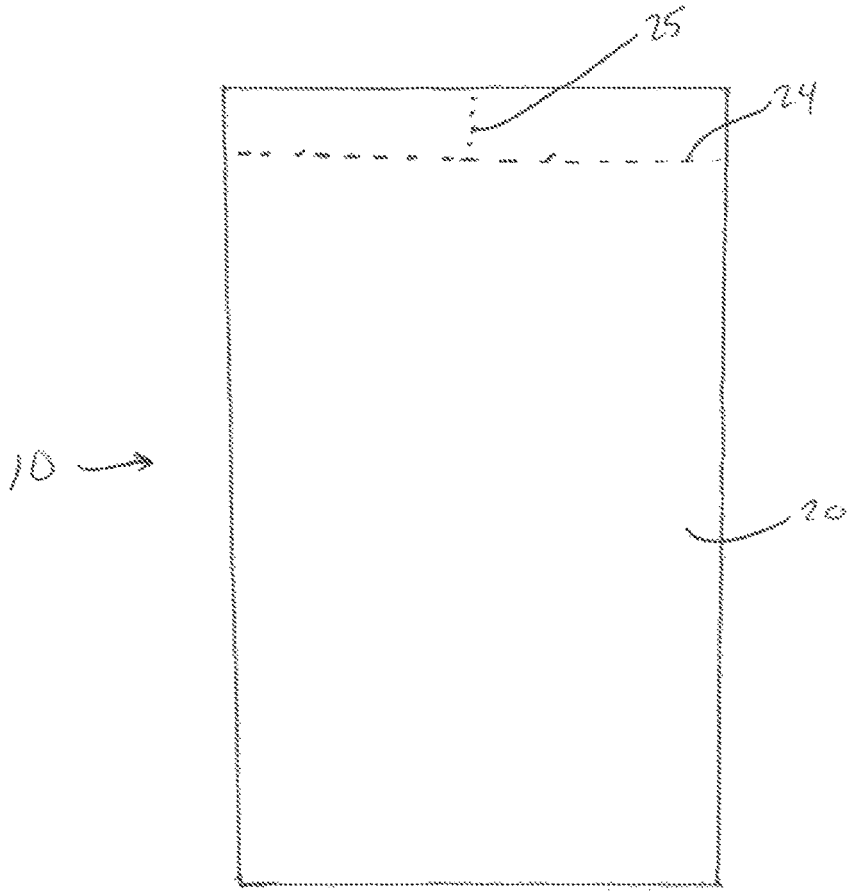
FIG. 53 is a rear view of the embodiment of FIG. 52.
Figure 54:
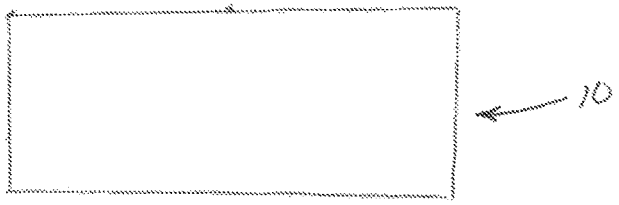
FIG. 54 is a top view of the embodiment of FIG. 52.
Figure 57:
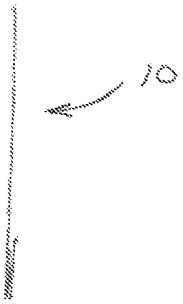
FIG. 57 is a side view of the embodiment of FIG. 52.
Figure 55:
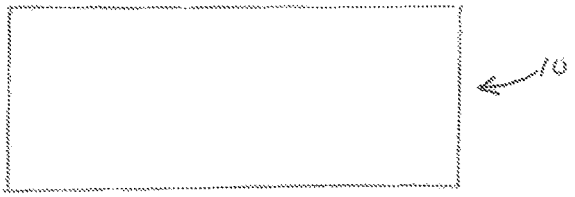
FIG. 55 is a bottom view of the embodiment of FIG. 52.
Figure 56:
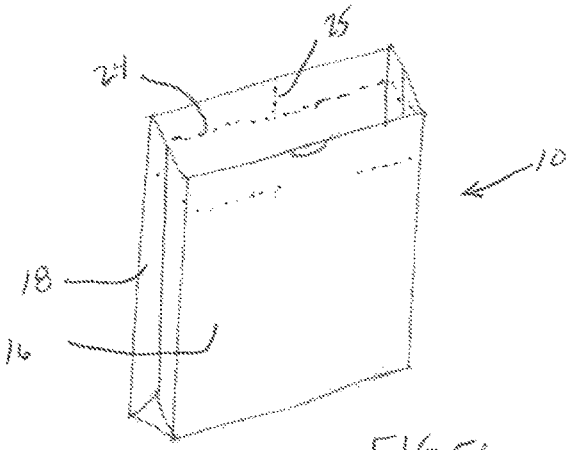
FIG. 56 is a perspective view of the embodiment of FIG. 52.
Figure 58:
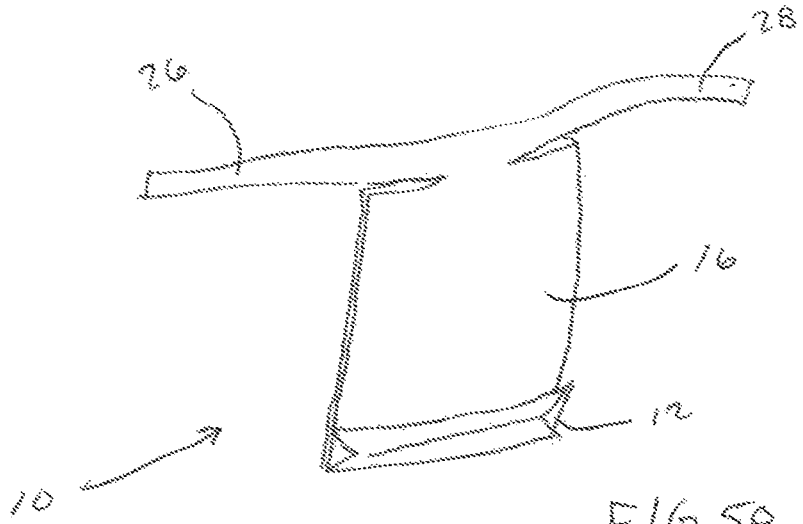
FIG. 58 is a perspective view of the embodiment of FIG. 52 with the straps removed along the perforations and with the straps extended and the bag closed.
Figure 59:
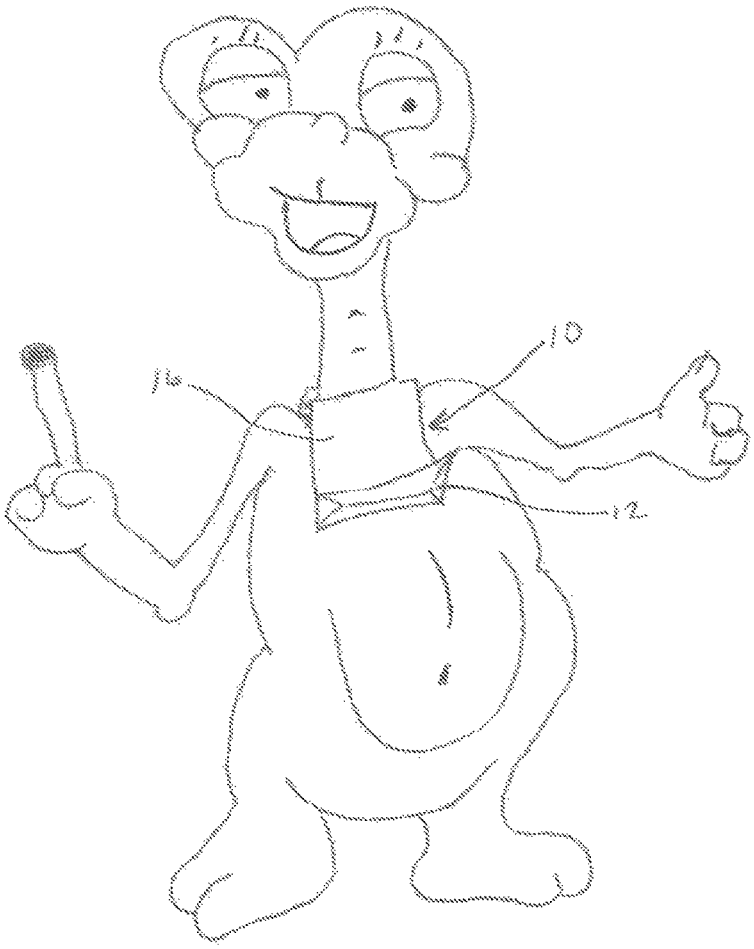
FIG. 59 is a perspective view of the embodiment of FIG. 52 in use by a person with the bag in a mostly closed, but partially open position to catch debris.

FIG. 52 is a front view of an exemplary embodiment of the present invention having horizontal and vertical perforations that extend all the way across the rear of the bag but not all the way across the front of the bag and there is no adhesive, it is a tuckable version. FIG. 53 is a rear view of the embodiment of FIG. 52. FIG. 54 is a top view of the embodiment of FIG. 52. FIG. 55 is a bottom view of the embodiment of FIG. 52. FIG. 56 is a perspective view of the embodiment of FIG. 52. FIG. 57 is a side view of the embodiment of FIG. 52. FIG. 58 is a perspective view of the embodiment of FIG. 52 with the straps removed along the perforations and with the straps extended and the bag closed. FIG. 59 is a perspective view of the embodiment of FIG. 52 in use by a person with the bag in a mostly closed, but partially open position to catch debris.

Figure 60:
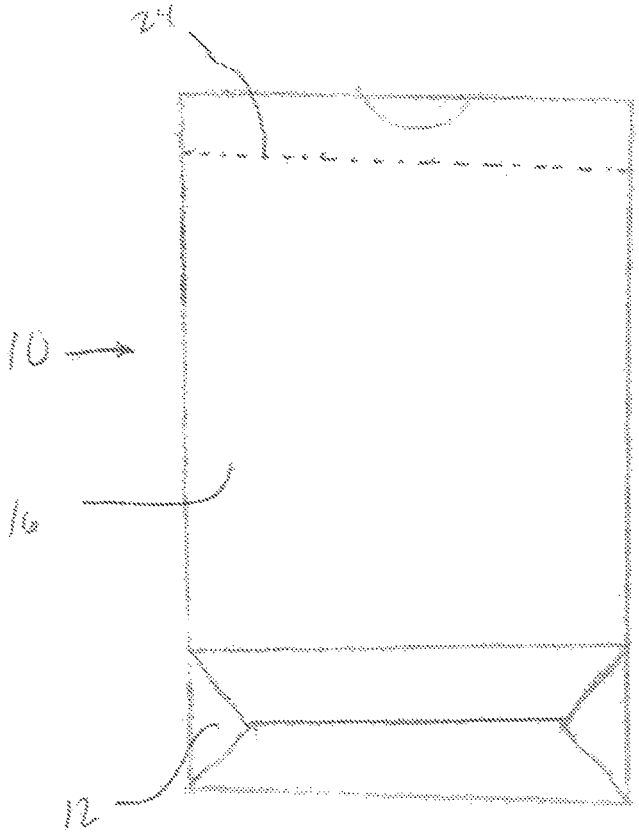
FIG. 60 is a front view of an exemplary embodiment of the present invention having horizontal perforations that extend all the way across the front of the bag but not all the way across the back of the bag and there is no adhesive, it is a tuckable version.
Figure 61:
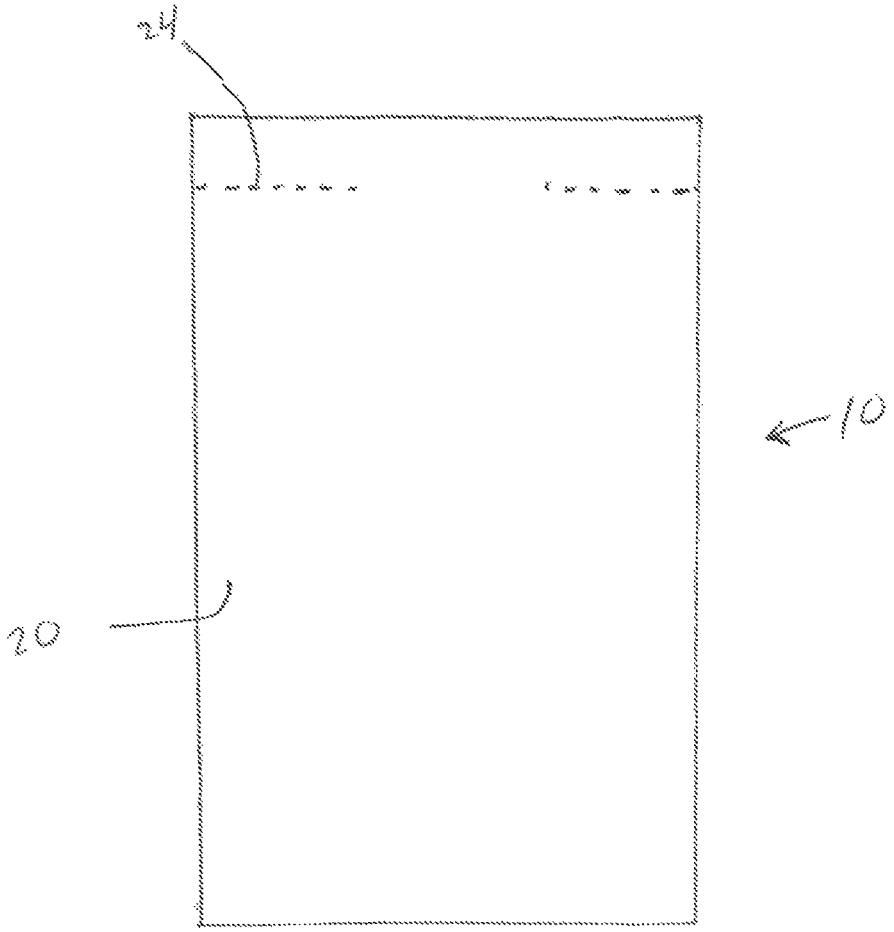
FIG. 61 is a rear view of the embodiment of FIG. 60.
Figure 62:
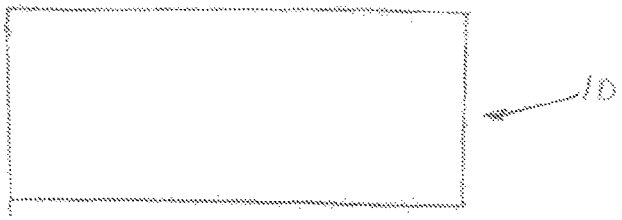
FIG. 62 is a top view of the embodiment of FIG. 60.
Figure 63:
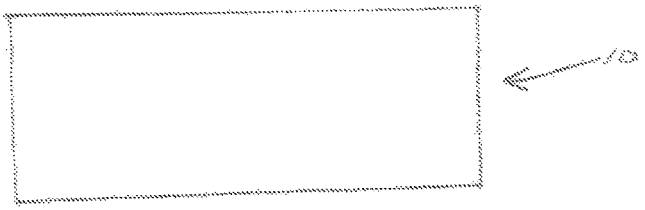
FIG. 63 is a bottom view of the embodiment of FIG. 60.
Figure 65:
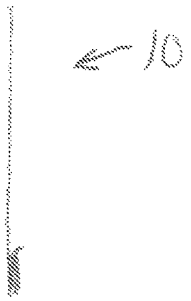
FIG. 65 is a side view of the embodiment of FIG. 60.
Figure 64:
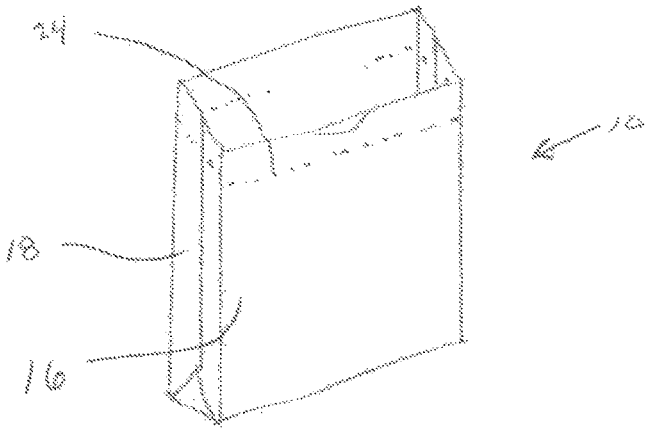
FIG. 64 is a perspective view of the embodiment of FIG. 60.
Figure 66:
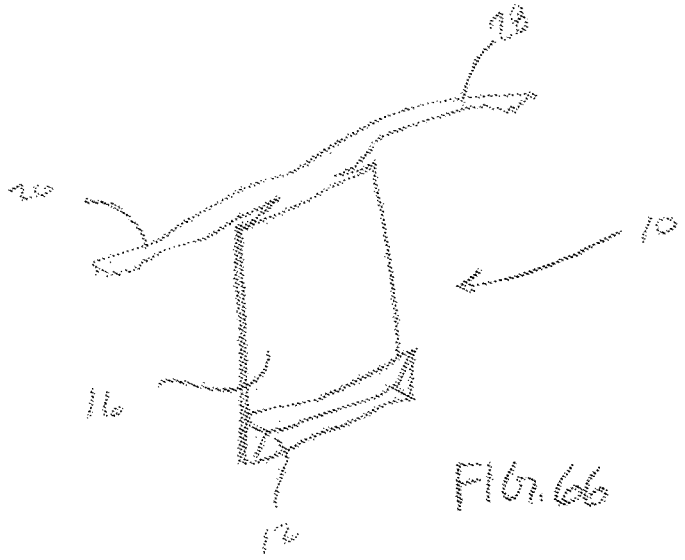
FIG. 66 is a perspective view of the embodiment of FIG. 60 with the straps removed along the perforations and with the straps extended and the bag closed.
Figure 67:
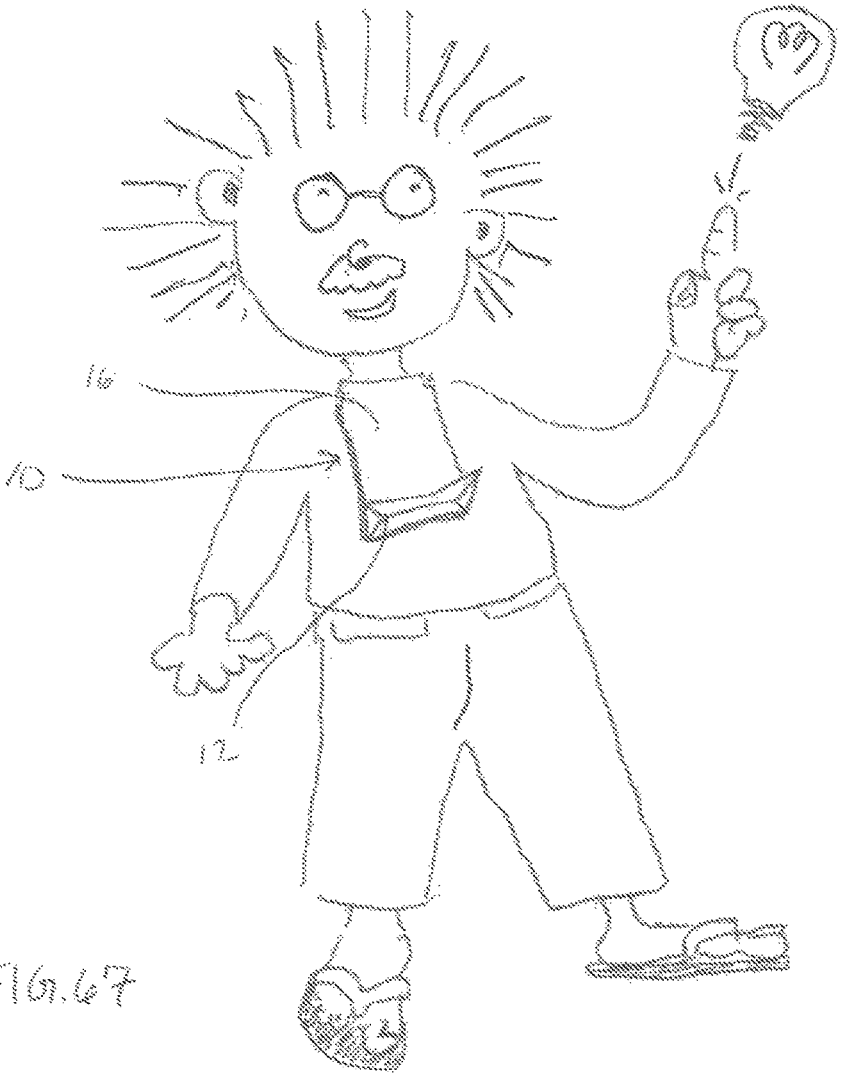
FIG. 67 is a perspective view of the embodiment of FIG. 60 in use by a person with the bag in a mostly closed, but partially open position to catch debris.

FIG. 60 is a front view of an exemplary embodiment of the present invention having horizontal perforations that extend all the way across the front of the bag but not all the way across the back of the bag and there is no adhesive, it is a tuckable version. FIG. 61 is a rear view of the embodiment of FIG. 60. FIG. 62 is a top view of the embodiment of FIG. 60. FIG. 63 is a bottom view of the embodiment of FIG. 60. FIG. 64 is a perspective view of the embodiment of FIG. 60. FIG. 65 is a side view of the embodiment of FIG. 60. FIG. 66 is a perspective view of the embodiment of FIG. 60 with the straps removed along the perforations and with the straps extended and the bag closed. FIG. 67 is a perspective view of the embodiment of FIG. 60 in use by a person with the bag in a mostly closed, but partially open position to catch debris.

Figure 68:
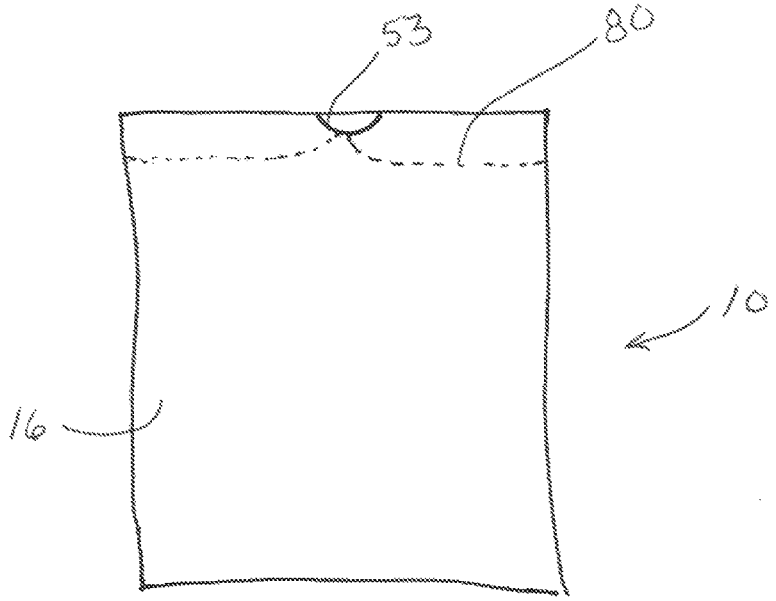
FIG. 68 is a front view of another exemplary embodiment of the present invention in which the bag is in an open condition and which illustrates another perforation route in which there is a vertical and horizontal component to the perforation line.

FIG. 68 is a front view of another exemplary embodiment of the present invention in which the bag is in an open condition and which illustrates another perforation route in which there is a vertical and horizontal component to the perforation line. In this embodiment, perforation line 80 has both horizontal, vertical, curved portions. As one of ordinary skill in the art would appreciate, the perforation line can have any desired shape. In this embodiment, the perforation line extends from notch 53 though, in other embodiments, the perforation line could extend from any other portion of the bag.

FIG. 69 is a front view of an exemplary embodiment of the present invention in a flat configuration prior to being placed into a bag configuration which illustrates an exemplary perforation line as well as a non-perforated portion. Illustrated for bag 10 is an exemplary perforation line 14, width W2 of non-perforated material and a corresponding notch 53 and tab 54 (which are of the same shape as it allows for little or no waste in cutting out the bag shapes).

Figure 70:
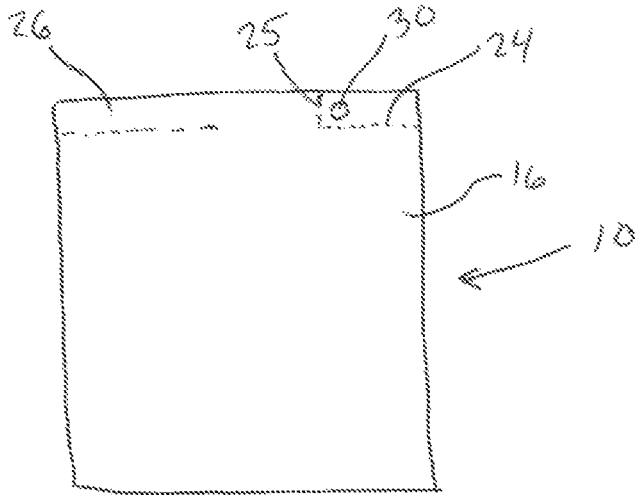
FIG. 70 is a front view of another exemplary embodiment showing a single strap embodiment having an attachment means.

FIG. 70 is a front view of another exemplary embodiment showing a single strap embodiment having an attachment means. In this embodiment, article 10 has a single strap 26 which may be separated from the remainder of the bag, side/wall 16, and perforations 24, 25. This embodiment further comprises an attachment means 30.

Figure 71:
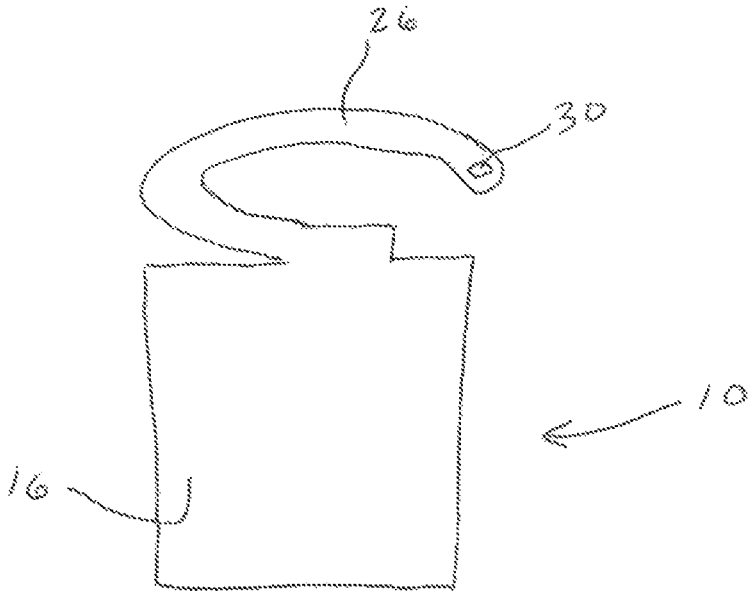
FIG. 71 is a front view of the embodiment of FIG. 70 in which the strap has been partially separated along the perforation line.

FIG. 71 is a front view of the embodiment of FIG. 70 in which the strap has been partially separated along the perforation lines such that strap 26 could be extended around the neck of a user and then attachment means 30 can be used to connect the end of strap 26 to the bag (or other article/component).

Figure 72:
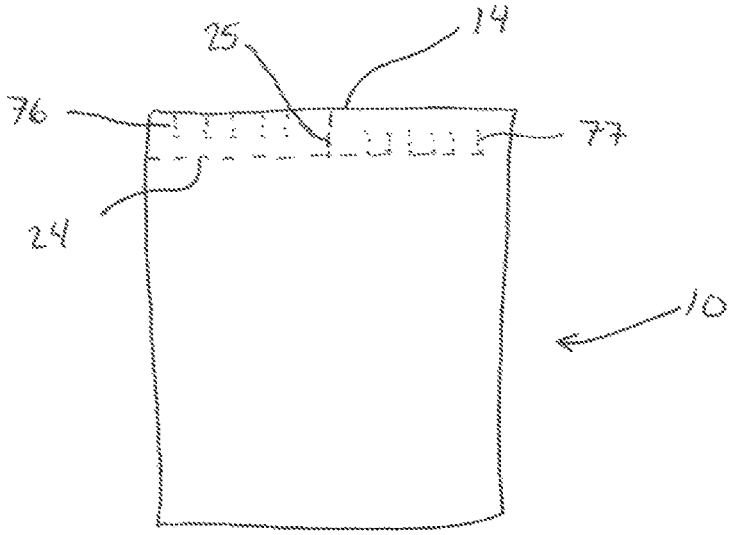
FIG. 72 is a rear view of another exemplary embodiment with perforated slits as the attachment mechanism between the straps.

FIG. 72 is a rear view of another exemplary embodiment of the present invention illustrating a version with perforated slits as the attachment mechanism between the straps. Illustrated is bag 10 having perforations 24, 25, additional vertical perforations 76 extending downward from an upper edge of a portion of a strap (which of course, may be of an orientation other than vertical), another set of vertical perforations 77 which extend upward from the perforation line 24 (i.e., once the straps are separated along perforation line 24, 25, the perforations 77 may selectively be opened/accessed/ripped, etc. One purpose of these additional perforations 76, 77 is that the user may select the appropriate slots/perforations and then rip that set and then the appropriate perforations are linked together (i.e., at least one from perforations 76 is then paired with a corresponding slit from perforations 77). This method allows the user/wearer to choose the appropriate collar belt/belt line diameter for comfort, etc.

Figure 73:
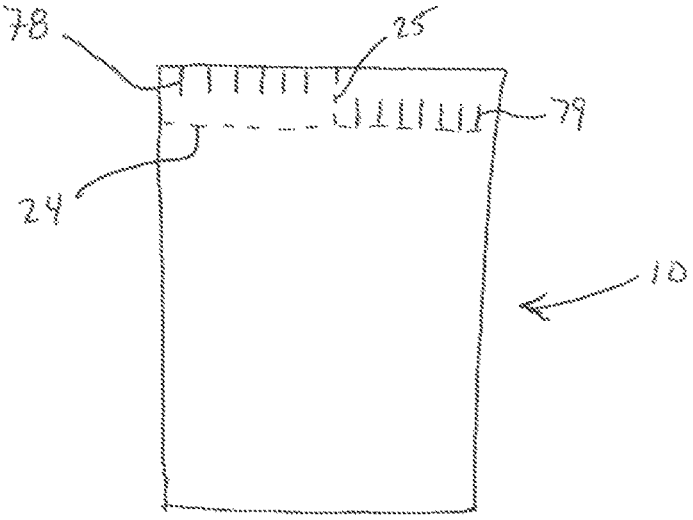
FIG. 73 is an embodiment similar to that of FIG. 72 except that there are slits present on select portions of the straps instead of perforated portions.

FIG. 73 illustrates an embodiment similar to that of FIG. 72 except that there are slits present on select portions of the straps instead of perforated portions. Illustrated for bag 10 is perforations 24, 25 and additional slits 78 extending downward from an upper edge of one of the strap portions and additional slits 79 which extend upwardly from a lower edge of one of the strap portions (lower edge being the case after the strap portion has been separated from bag 10 along perforations 24). Once the straps have been separated (i.e., perforations 24), the user can simply select the desired/appropriate slit pairing (i.e., one from the first strap and one from the second strap) that provides the wearer with a comfortable fit around the wearer's neck, etc.

There may be advantages to having the material of the straps portions of the invention having a higher structural integrity than other portions of the bag as this is an area that may encounter increased activity over traditional bags, i.e., once the straps are separated along the perforation lines, the straps should be securely and sufficiently held to the remaining part of the bag (i.e., non-perforated portion) without the bag or straps ripping, tearing, etc. Such increased structural integrity could come through many methods including, but not limited to, thicker materials, alternate materials, additional layers, surface coating, material treatment, and surface treatment. This may be particularly useful or advantageous in embodiments such as that illustrated/discussed in FIGS. 72, 73. Note that the number of perforations or slots may vary from zero to any number. In some embodiments, the number of slits or perforated sections on the straps is between zero and twelve.

Various members of the present invention may be comprised partially, or wholly, of any suitable material including, but not limited to, paper, plastic, and cloth. Although various components of the present invention may be illustrated as being of a particular shape for convenience, such components may be of any suitable shape, configuration, orientation, etc.

Various components of the disclosed embodiments may be attached to each other, or to other members, (including the attachment means) by any suitable means including, but not limited to, adhesive, taping, gluing, slots, slits, notches, and snaps.

While the specification has been described in detail with respect to specific embodiments thereof, it will be appreciated that those skilled in the art, upon attaining an understanding of the foregoing, may readily conceive of alterations to, variations of, and equivalents to these embodiments.

What is claimed is:

1. A bag, said bag comprised of:

a flexible material including a floor and a plurality of upstanding walls projecting from the floor, wherein each two adjacent walls meet one another at a corner of the bag, and there is at least one perforated section near the opening of the bag such that a user may rip the bag along said at least one perforated section to reveal one or more straps wherein said one or more straps includes a first strap and a second strap, and said first strap has a set of perforations extending downwardly from an upper edge of said strap and said second strap has a set of perforations extending upwardly from a lower edge of said strap.

2. A bag, said bag comprised of:

a flexible material including a floor and a plurality of upstanding walls projecting from the floor, wherein each two adjacent walls meet one another at a corner of the bag, and there is at least one perforated section near the opening of the bag such that a user may rip the bag along said at least one perforated section to reveal one or more straps wherein said one or more straps includes a first strap and a second strap, and said first strap has a set of slits extending downwardly from an upper edge of said strap and said second strap has a set of slits extending upwardly from a lower edge of said strap.

* * * * *